US008272669B2

(12) United States Patent
Flynn et al.

(10) Patent No.: US 8,272,669 B2
(45) **Date of Patent: *Sep. 25, 2012**

(54) LABEL ASSEMBLY FOR APPLYING A LABEL TO AN OBJECT

(75) Inventors: Timothy J. Flynn, Key Largo, FL (US); Patrick J. Flynn, Redlands, CA (US); Geoffrey T. Brossard, Crystal Lake, IL (US)

(73) Assignees: Timothy J. Flynn, Key Largo, FL (US); Continental Datalabel, Inc., Elgin, IL (US)

( * ) Notice: Subject to any disclaimer, the term of this patent is extended or adjusted under 35 U.S.C. 154(b) by 477 days.

This patent is subject to a terminal disclaimer.

(21) Appl. No.: 12/426,823

(22) Filed: Apr. 20, 2009

(65) Prior Publication Data

US 2009/0295140 A1 Dec. 3, 2009

Related U.S. Application Data

(63) Continuation-in-part of application No. 11/716,388, filed on Mar. 9, 2007, now Pat. No. 7,726,696, and a continuation-in-part of application No. 11/585,783, filed on Oct. 24, 2006, now Pat. No. 7,874,594, and a continuation-in-part of application No. 11/585,654, filed on Oct. 24, 2006, now Pat. No. 7,959,187.

(51) Int. Cl.
*B42D 15/00* (2006.01)

(52) U.S. Cl. ..... 283/81; 283/101

(58) Field of Classification Search ..... None
See application file for complete search history.

(56) References Cited

U.S. PATENT DOCUMENTS

| | | | | |
|---|---|---|---|---|
| 6,073,377 | A | 6/2000 | Mehta | |
| 6,479,118 | B1 | 11/2002 | Atkinson | |
| 6,776,866 | B2 | 8/2004 | Flynn et al. | |
| 7,140,136 | B2 * | 11/2006 | Flynn et al. | 40/638 |
| 7,726,696 | B2 * | 6/2010 | Flynn et al. | 283/81 |
| 7,770,933 | B2 | 8/2010 | Yamamoto | |
| 7,959,187 | B2 * | 6/2011 | Flynn et al. | 283/81 |
| 7,963,564 | B2 * | 6/2011 | Flynn et al. | 283/81 |
| 2005/0238836 | A1 | 10/2005 | Hodsdon | |
| 2006/0011076 | A1 | 1/2006 | Durban | |

(Continued)

OTHER PUBLICATIONS

Co-pending U.S. Appl. No. 12/581,660, "Label Assembly Having Angled Registration Tabs for Applying a Label to an Object," Filed Oct. 19, 2009.

(Continued)

*Primary Examiner* — Lesley D Morris
*Assistant Examiner* — Christopher E Veraa
(74) *Attorney, Agent, or Firm* — Pauley Petersen & Erickson

(57) ABSTRACT

A label assembly that includes a face sheet with at least one label shape defined by one or more tearable lines of separation, a back sheet adjacent to the face sheet, and an adhesive material disposed between the face sheet and the back sheet. The back sheet has a removable panel disposed over the label shape adhesive material and a registration tab aligned with the label shape. The registration tab includes a foldable portion that when folded provides rigidity when the tab is used as a supporting leg to place the label assembly over an object during labeling.

21 Claims, 20 Drawing Sheets

U.S. PATENT DOCUMENTS

| | | | |
|---|---|---|---|
| 2006/0032764 | A1 | 2/2006 | Swenson |
| 2006/0037507 | A1 | 2/2006 | Trigg et al. |
| 2008/0093839 | A1 | 4/2008 | Flynn et al. |
| 2008/0093840 | A1 | 4/2008 | Flynn et al. |
| 2008/0093841 | A1 | 4/2008 | Flynn et al. |
| 2009/0295143 | A1 | 12/2009 | Flynn et al. |

OTHER PUBLICATIONS

Co-pending U.S. Appl. No. 12/581,672, "Label Assembly Having Raisable Registration Tabs Disposed Over Removable Shapes," Filed Oct. 19, 2009.

* cited by examiner

FIG. 26
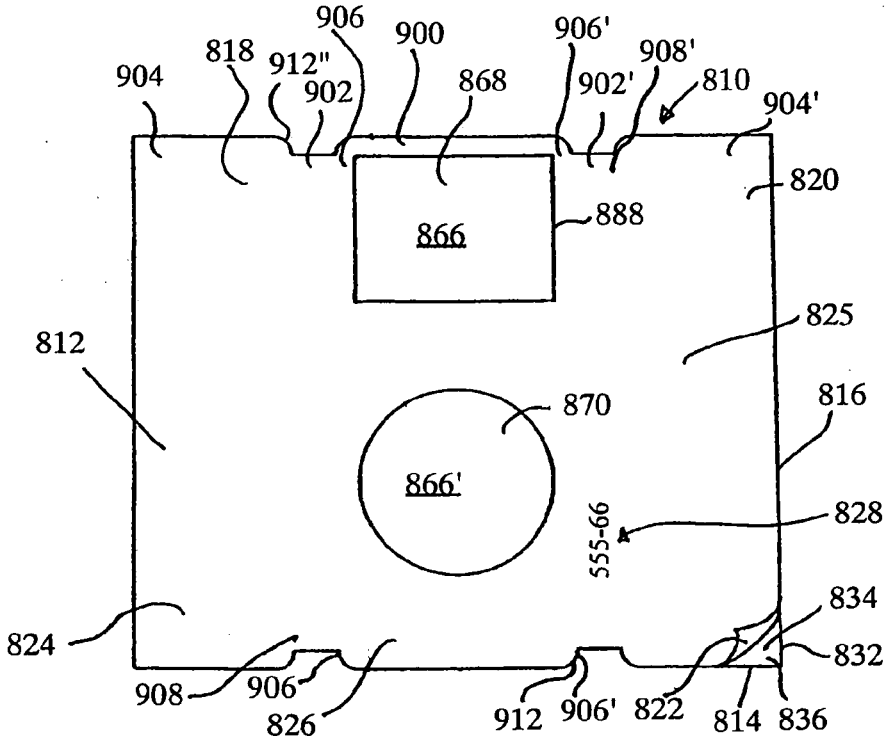
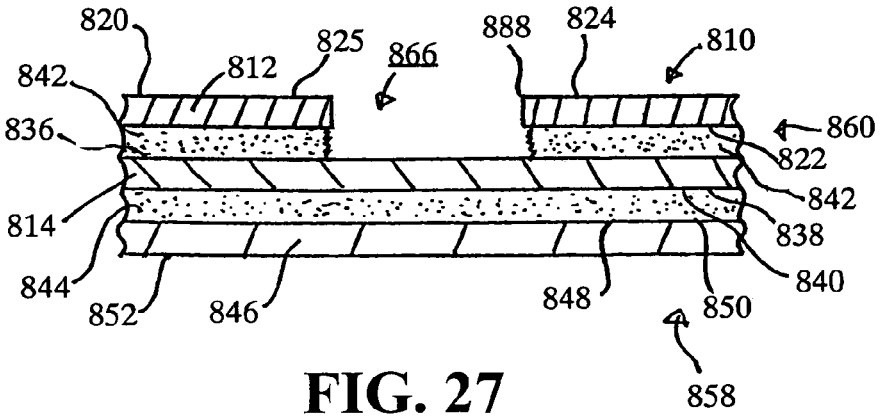
FIG. 27

LABEL ASSEMBLY FOR APPLYING A LABEL TO AN OBJECT

CROSS REFERENCE TO RELATED APPLICATIONS

This application is a continuation-in-part of each of: U.S. application, Ser. No. 11/585,654, filed on 24 Oct. 2006 now U.S. Pat. No. 7,959,187; U.S. application, Ser. No. 11/716,388, filed on 09 Mar. 2007 now U.S. Pat. No. 7,726,696, which is a continuation-in-part of U.S. application, Ser. No. 11/585,654; and U.S. application, Ser. No. 11/585,783, filed on 24 Oct. 2006 now U.S. Pat. No. 7,874,594. The co-pending parent applications are hereby incorporated by reference herein in their entirety and are made a part hereof, including but not limited to those portions which specifically appear hereinafter.

FIELD OF THE INVENTION

This invention is directed to a label assembly for application of a label to an object having a planar and/or a non-planar surface, e.g., an IPOD® electronic music player or other MP3 player, a personal digital assistant, or a cell phone. The invention is also directed to a printable sheet of such labels, and a method for printing and/or applying the printed labels, such as by a consumer.

SUMMARY OF THE INVENTION

The label assembly of this invention allows for aligning and applying a label to an object, for example, an object having two or more surfaces at an angle to one another. The label assembly of this invention is particularly useful in applying a label that has an intricate/uneven surface and/or is to be wrapped around an object, such as for decorating or personalizing small consumer electronics such as music players and cell phones. The label assembly and method of this invention provide correct alignment of the label on the object to be labeled without the need for a separate label application apparatus.

A general object of the invention can be attained, at least in part, through a label assembly including a face sheet with at least one label shape defined by at least one tearable line of separation, a back sheet adjacent to the face sheet, and an adhesive material disposed between the face sheet and the back sheet. The back sheet includes a removable panel disposed over the label shape. A registration tab is defined by at least one tearable line of separation and is aligned with a portion of the label shape. The registration tab is raisable above the back sheet and includes a tab fold line defining a foldable portion.

The invention further comprehends a label assembly. The label assembly includes a face sheet having a printed or printable surface, a label shape defined in the face sheet by at least one first tearable line of separation, an adhesive material coating a surface of the face sheet opposite the printed or printable surface, and a back sheet disposed over the adhesive material. The back sheet includes a back sheet surface opposite the adhesive material and a removable panel is defined in the back sheet by at least one second tearable line of separation and disposed over the label shape. A registration tab is cut in the back sheet and raisable above the back sheet surface. The registration tab includes a tab fold line defining a foldable portion that is aligned with the first label shape.

The invention still further comprehends a method for labeling an object. The method uses the label assembly of this invention, such as described above, that includes a registration structure aligned with a label shape and a removable panel. The method begins with placing the object on a surface. The removable panel is removed to expose the adhesive material on a first portion of the label shape. The registration tab is aligned with the object and the label assembly is placed over the object with the registration tab against the object. The label shape is then adhered to the first portion of the label shape and the object is removed with the adhered label shape from the label assembly.

Other objects and advantages will be apparent to those skilled in the art from the following detailed description taken in conjunction with the appended claims and drawings.

BRIEF DESCRIPTION OF THE DRAWINGS

FIG. 26 is a plan view of a label, according to another embodiment of this invention.

FIG. 27 is a partial and sectional view of a label assembly, according to one embodiment of this invention, showing a label portion attached to a carrier back sheet.

DETAILED DESCRIPTION OF THE INVENTION

Figure 1:
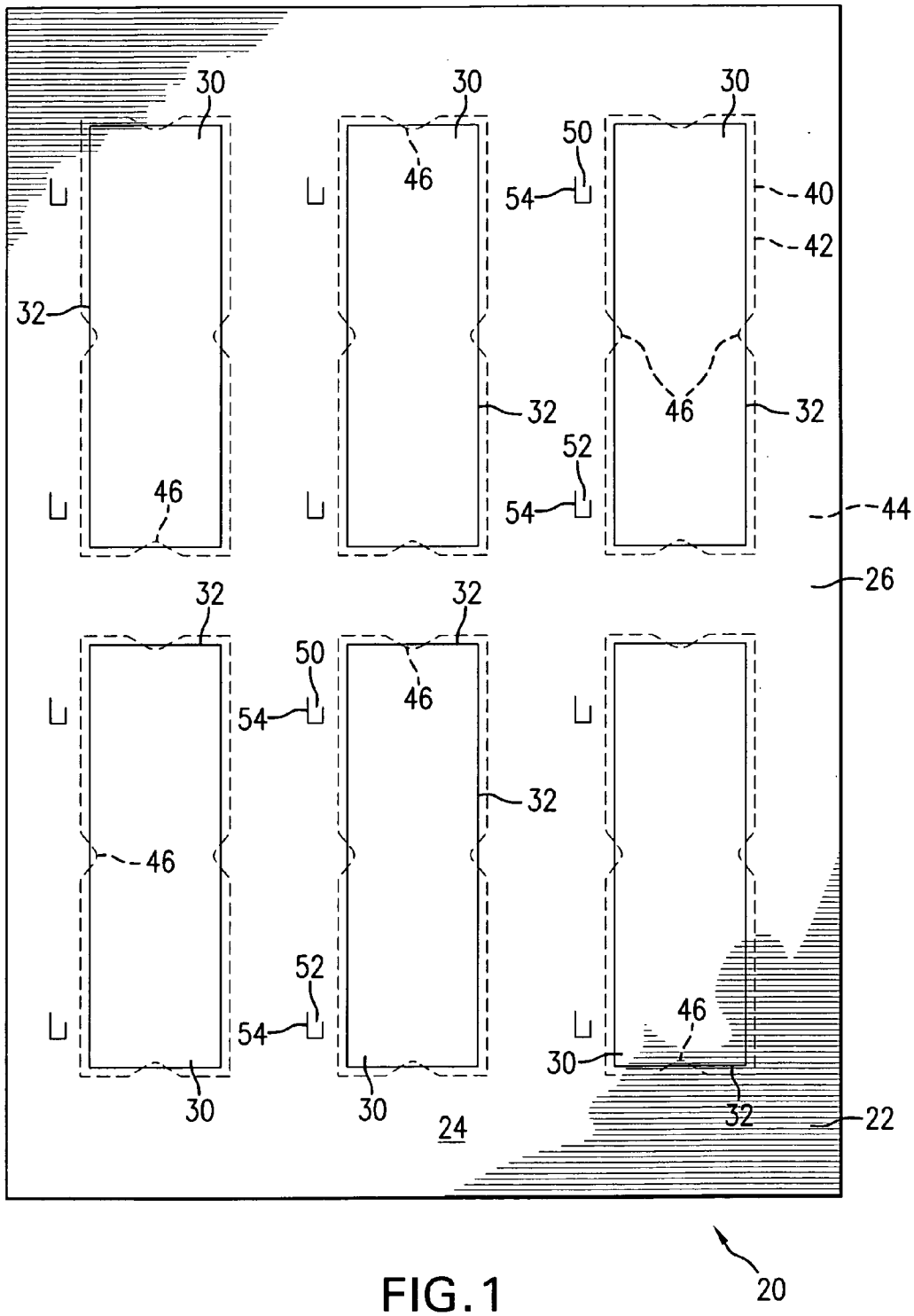
FIG. 1 is a plan view of a label assembly according to one embodiment of this invention.

FIG. 1 shows a label sheet 20 (not necessarily shown to scale) according to one embodiment of this invention. Label sheet 20 is desirably formed of a face sheet 22 and a back sheet (not shown in FIG. 1). The back sheet is desirably about the same size as the face sheet 22, but may be slightly larger or smaller than the face sheet 22. The surface of the face sheet 22 that is disposed toward the back sheet includes an adhesive material coating. The adhesive coating can include any adhesive material known and available to those skilled in the art for forming pressure sensitive, or self-adhesive, labels. The back sheet is desirably formed of a material to which the adhesive coating adheres significantly less than to the face sheet 22, such as is known for forming pressure sensitive, or self-adhesive, labels.

The sheet 20 is of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches, however for label sheets such as shown in FIGS. 15-22 the size can be smaller. The face sheet 22 is preferably, but not necessarily, constructed of any suitable paper, paper composite, non-metal and/or metal material that can be used as a label. Other suitable materials for constructing the sheet 22 include fabric, plastic, and metal foils. The adhesive coating covered by the back sheet is applied to the face sheet 22 in any suitable manner known to those skilled in the art. The face sheet 22 desirably has a printable surface 24 on a side opposite the adhesive coating.

The face sheet and the printable surface 24 can be any of a variety of face materials used to make pressure sensitive or self-adhesive labels. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. The face sheet can also be pre-printed by the manufacturer or retailer with graphics and/or test desirable to a consumer user. The printed surface can include any desirably image or text, or can be colored or include holographic images.

The face sheet 22 includes a plurality of label shapes 30, each defining in the face sheet 22 an individual label according to this invention. The phrase "shape", or the phrase "removable or tearable shape", is intended to relate to a shape, such as, but not limited to, the rectangular shapes identified in FIG. 1 by element reference numerals 30, that can be torn away from a remaining portion 26 of the face sheet 22, by using tearable lines of separation 32. The term "tearable lines of separation," also referred to as simply "tearable lines," "lines of separation" or "separation lines," relate to physical or structural lines that can be torn to separate a removable portion or section from the remaining portion or section of the label and/or the label assembly according to this invention. The label portion of this invention may further include additional separation lines and/or lines of weakness and/or fold lines to aid in positioning and/or adhering the label around an object. Lines of separation and/or lines of weakness according to this invention can be formed of a die-cut line, a laser die-cut line, a score cut line, a perforation line (such as having a plurality of cuts and ties), a microperforation line, a chemically etched line, a liquid etched line, a gas etched line, or any combination of these types of separation, or any other suitable structure that enables separation. A preferred type of tearable line 32 is a line that is die-cut. The label shapes 30 can be die-cut along at least a portion of a periphery, such that the label shapes 30 can be easily removed or separated from the remaining portion 26 of the sheet 22, for example after the sheet 22 is run through a printer.

The back sheet includes a removable panel 40 shown in phantom. The removable panel is defined by tearable lines of separation (shown as dashed lines 42 in FIG. 1) in a surface of the back sheet that is disposed opposite the front sheet 22. A removable panel 40 is disposed over the adhesive coated side of each label shape 30. In the embodiment shown in FIG. 1, the removable panel 40 is desirably and optionally sized slightly larger than the label shape 30. A remaining portion 44 of the back sheet that is disposed around, and desirably surrounding, the removable panel 40 includes a plurality of retainer tabs 46 extending from the remaining portion 44 and adhering to the label shape 30.

The label sheet 20 includes a registration structure, embodied in FIG. 1 as two spaced apart tabs 50 and 52, aligned with each label shape 30 and the removable panel 40. As will be described in more detail below, the registration structure of this invention allows for improved and easier application of a label to an object with a non-planer surface, for example, a pen or a pencil. In the embodiment of FIG. 1, the tabs 50 and 52 are each defined on three sides by a tearable line of separation 54 in both the back sheet and the face sheet 22. The tabs 50 and 52 are raisable to an extended position by folding outward above the back sheet.

Figure 2:
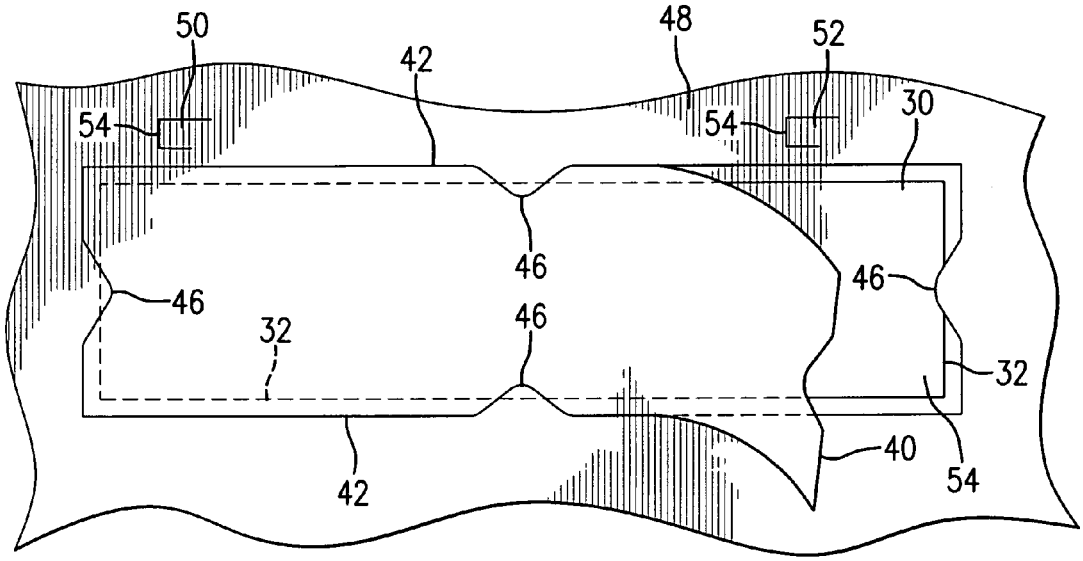
FIG. 2 is a plan view of a portion of the label assembly of FIG. 1, viewed from an opposite side.
Figure 3:
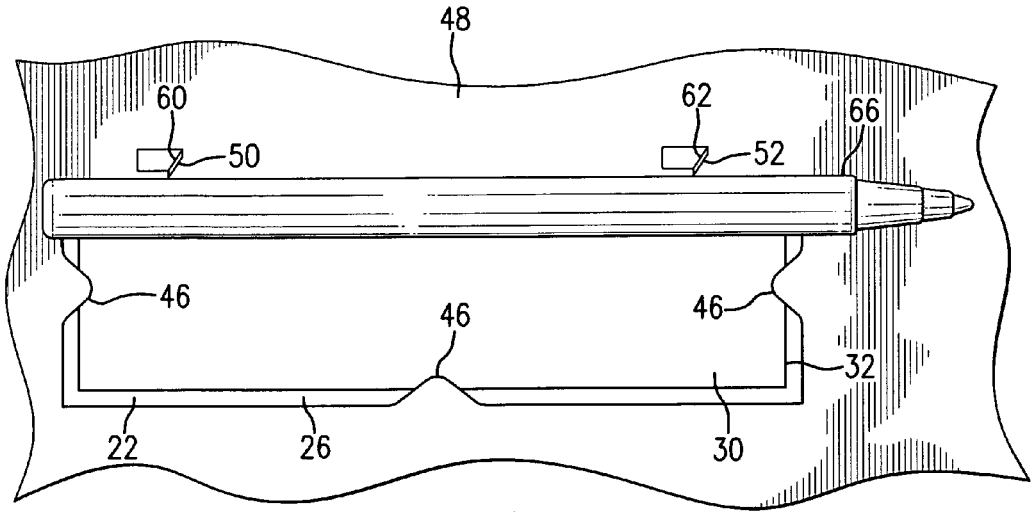
FIGS. 3 and 4 illustrate an operation of the label assembly of FIG. 1.
Figure 4:
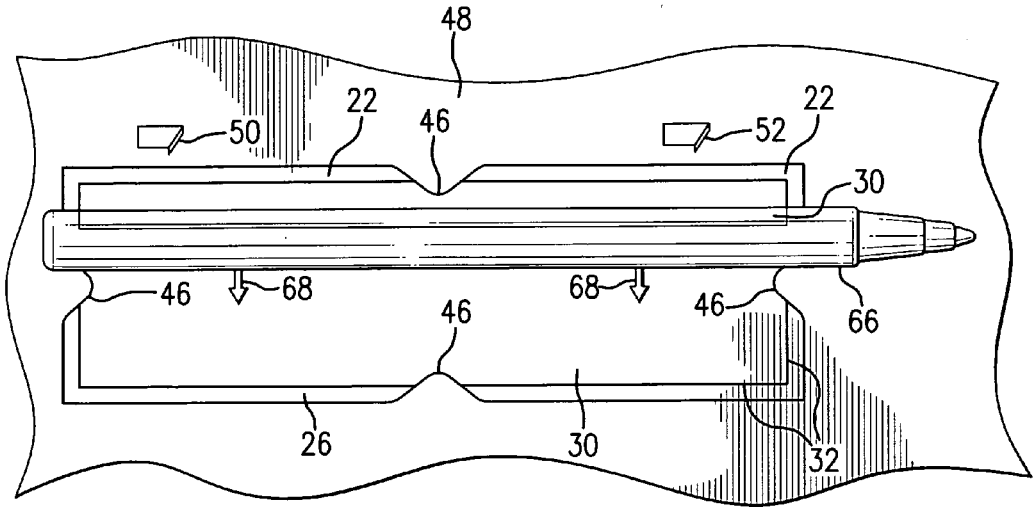

FIGS. 2-4 illustrate the operation of the label sheet 20 of FIG. 1 for labeling an object having a non-planar surface, shown as a pen. Desirably first, the label sheet 20 is routed through a printer to print text and/or graphics onto the printable surface 24 of at least one label shape 30. FIG. 2 shows a printed label shape 30 of sheet 20 placed with the printed face sheet 22 downward on a surface. The removable panel 40 of back sheet 48 is removed along lines of separation 42 to expose the adhesive material 54 on the non-printed side of the label shape 30.

As shown in FIGS. 3 and 4, the tabs 50 and 52 of the registration structure are raised by the user above the surface of the back sheet 48. The tabs 50 and 52 are raised by folding along fold lines 60 and 62, respectively. FIG. 3 shows the label sheet 20 with the removable panel 40 removed and a pen 66 placed against the tabs 50 and 52. As discussed above, desirably the tabs 50 and 52 are formed by one or more die cuts that extend through both of the back sheet 48 and the face sheet 22, thereby desirably providing increased tab thickness and thus rigidity for receiving the pen 66 there against. With the pen 66 against the raised tabs 50 and 52, the pen may or may not be in contact with the adhesive material on the label shape 30 and/or the remaining portion 26. The tabs 50 and 52 desirably assist the user in positioning the pen 66 in proper alignment with the label shape 30 to promote or provide a desirable straight label application. The retainer tabs 46 assist in maintaining the label shape 30 within the face sheet 22 upon removing the removable panel 40 and during positioning of the pen 66 against the tabs 50 and 52.

To apply the label shape 30 to the pen 66, the pen 66 is rolled by the user from the tabs 50 and 52 across the label shape 30, in the direction shown by arrows 68 in FIG. 4. As the pen 66 is rolled, the adhesive material 54 of the label shape 30 adheres to the cylindrical shaft of the pen 66, thereby separating and removing the label shape 30 from the face sheet 22 and adhering the label shape 30 around the pen 66. Thus, the label 30 can be simply and straightly applied to a rounded or other non-planar surface manually by a user. The apparatus and method of this invention can also be incorporated into an automatic or manual label application machine.

The removable panel and the registration structure of this invention allow for relatively easier and better placement of a label onto a rounded or otherwise non-planar surface. As will be appreciated by those skilled in the art following the teachings herein provided, various and alternative sizes, shapes, and configurations are available for the labels, removable panels, and registration structures according to this invention, such as, without limitation, shown in FIGS. 5 and 6.

Figure 5:
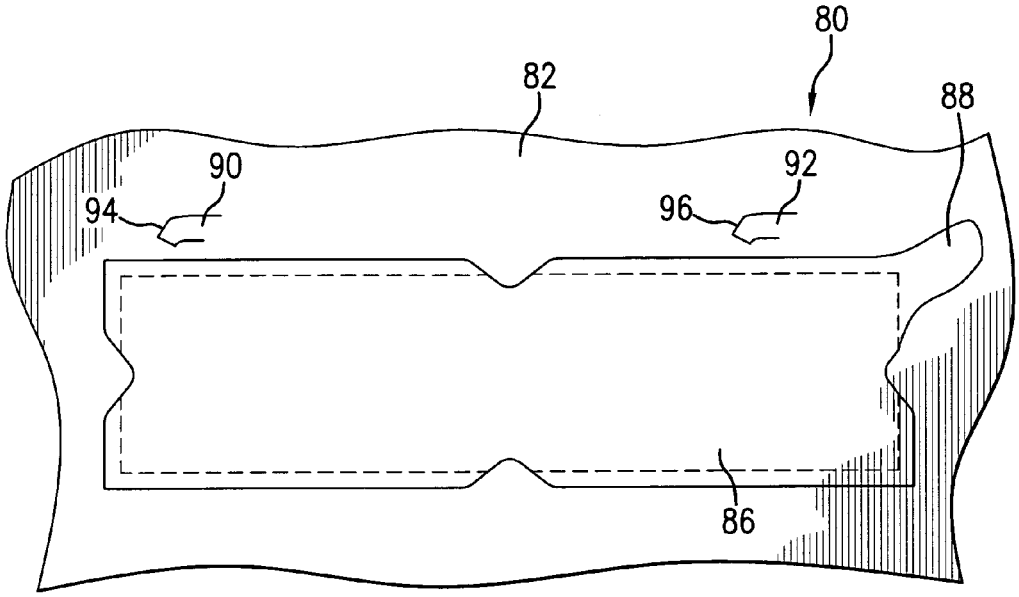
FIG. 5 is a plan view of a portion of a label assembly according to another embodiment of this invention.

FIG. 5 illustrates a portion of a label sheet 80, viewed from the back sheet 82, according to another embodiment of this invention. The label sheet 80 differs from the embodiment of FIG. 1 in the shape of tabs 90 and 92 of the registration structure and removable portion 86. In the embodiment of FIG. 5, the tabs 90 and 92 have bent portions 94 and 96, respectively, that can, for example, desirably form a flat edge that in the raised position is perpendicular to the back sheet 82 and against which a pen or similar object can be placed. In a similar embodiment, the tabs can be formed as hook-like tabs that include a portion that extends over and/or around a portion of the pen or pencil. Also in the embodiment of FIG. 5, the removable portion 86 includes a corner starter flap, or removal tab, 88 that is adapted to allow for easier removal of the removable panel 86 by the user.

Figure 6:
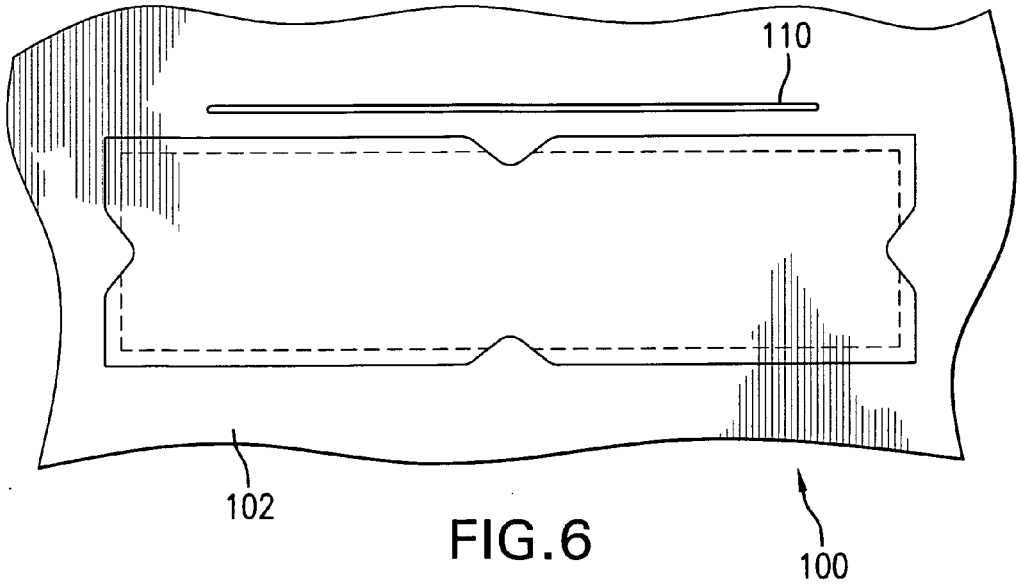
FIG. 6 is a plan view of a portion of a label assembly according to yet another embodiment of this invention.

Other structures than cut-out tabs are available for the registering structure according to this invention. In one embodiment, the registration structure comprises an embossed structure. FIG. 6 shows a label sheet 100 having an embossed structure according to one embodiment of this invention. In FIG. 6, the label sheet 100 includes aback sheet 102. A score line 110 is embossed into the label sheet 100 to provide a raised registration structure against which a pen or other object can be placed for alignment. Desirably, the score line 110 is only as high as is needed for the user to determine when an object is being placed against it. The score line 110 can be formed by scoring the face sheet of the label sheet 100 to cause the score line 110 to be raised above the flat back surface of the label sheet 100 (desirably without cutting through the label sheet 100). As will be appreciated, other embossed or raised shapes are available for the embossed registration structure of this invention, such as, for example, two or more raised domes. Any structure that is or can be raised above the label assembly of this invention, can be used as a registration structure for aligning an object, and is contemplated herein.

Figure 7:
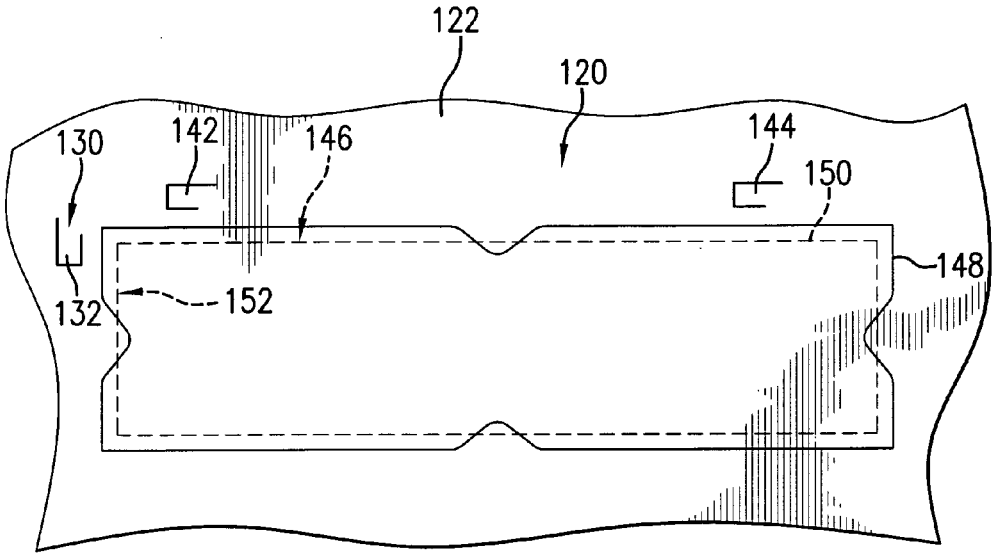
FIG. 7 is a plan view of a portion of a label assembly according to yet another embodiment of this invention.
Figure 8:
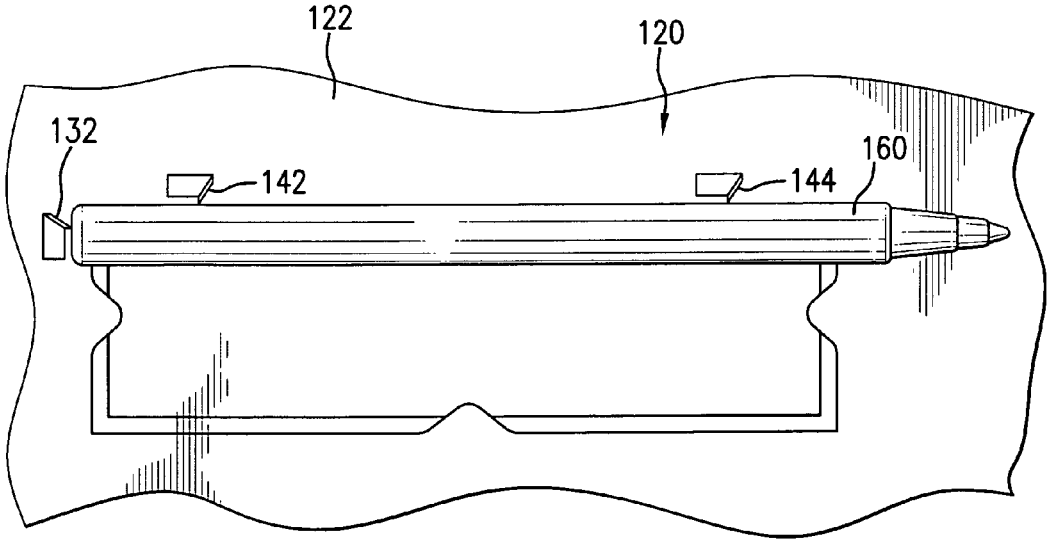
FIG. 8 illustrates an operation of the label assembly of FIG. 7.

FIGS. 7 and 8 illustrate a portion of a label sheet 120, viewed from the back sheet 122, according to another embodiment of this invention. The label sheet 120 differs from the embodiment of FIG. 1 by including an alignment structure 130 in addition to the tabs 142 and 144 forming the registration structure. The alignment structure 130 is formed of a single alignment tab 132, which in this embodiment of the invention is similar is size, shape and function to each of the registration structure tabs 142 and 144.

The registration structure tabs 142 and 144 are disposed adjacent a first side 146 of the label shape 150. The alignment tab 132 is disposed adjacent a second side 152 of label shape 150. As shown in FIG. 8, the alignment structure of this invention desirably acts as an end stop for the pen 160 when the alignment tab 132 is raised above the back sheet 122 by the user. The alignment structure desirably assists in obtaining consistent placement of the labels on the pen. As will be appreciated by those skilled in the art following the teachings herein provided, various sizes, shapes, placements and configurations are available for the alignment structure of this invention. For example, the additional configurations of the registration structure according to this invention, such as, for example, shown in FIGS. 5 and 6, are available for configuration as the alignment structure, depending on need and the object to be labeled. In another embodiment, more than one alignment tab can be placed along side 146, or two alignment tabs can be placed on opposing sides of a label.

Figure 9:
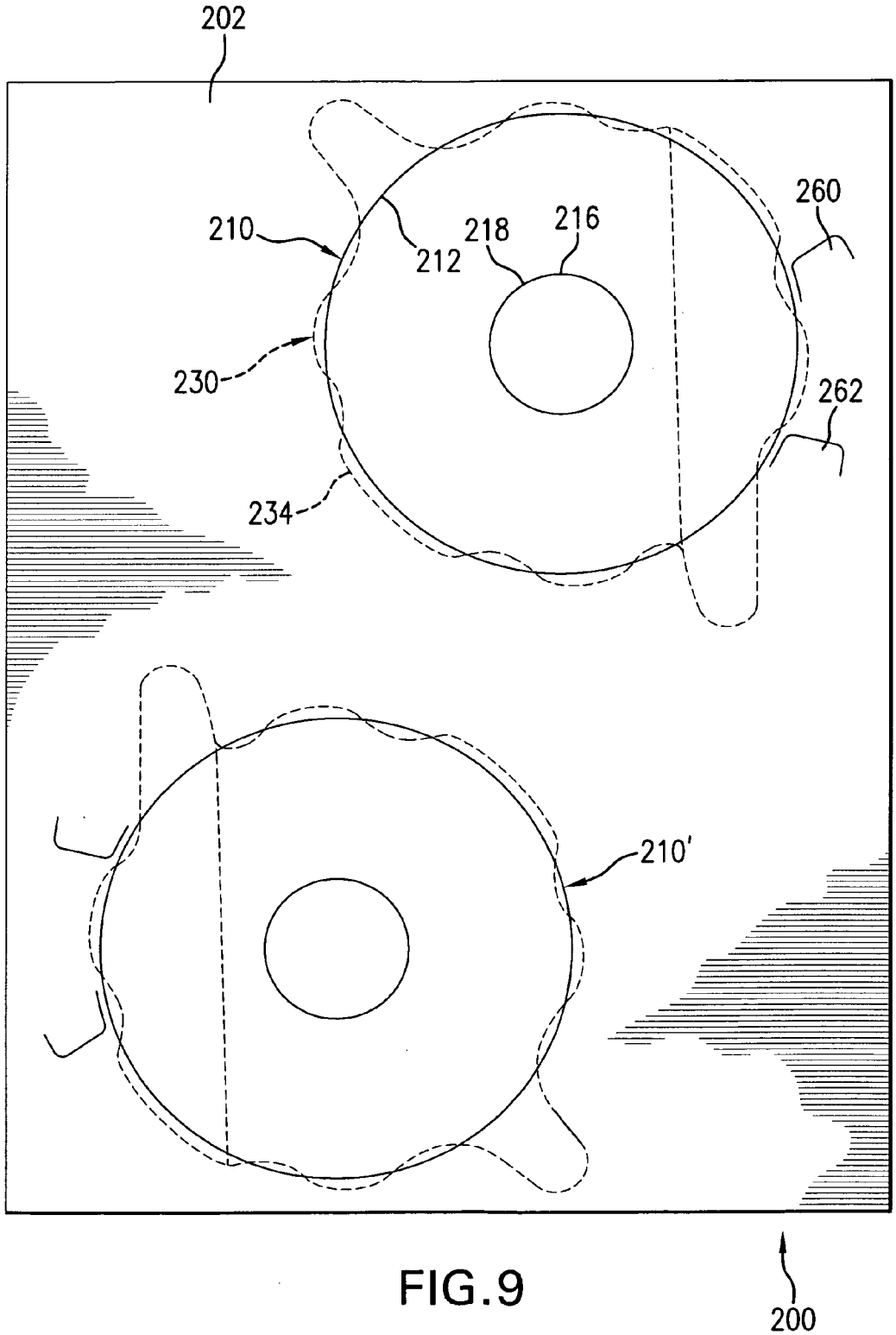
FIG. 9 is a plan view of a label assembly according to yet another embodiment of this invention.
Figure 10:
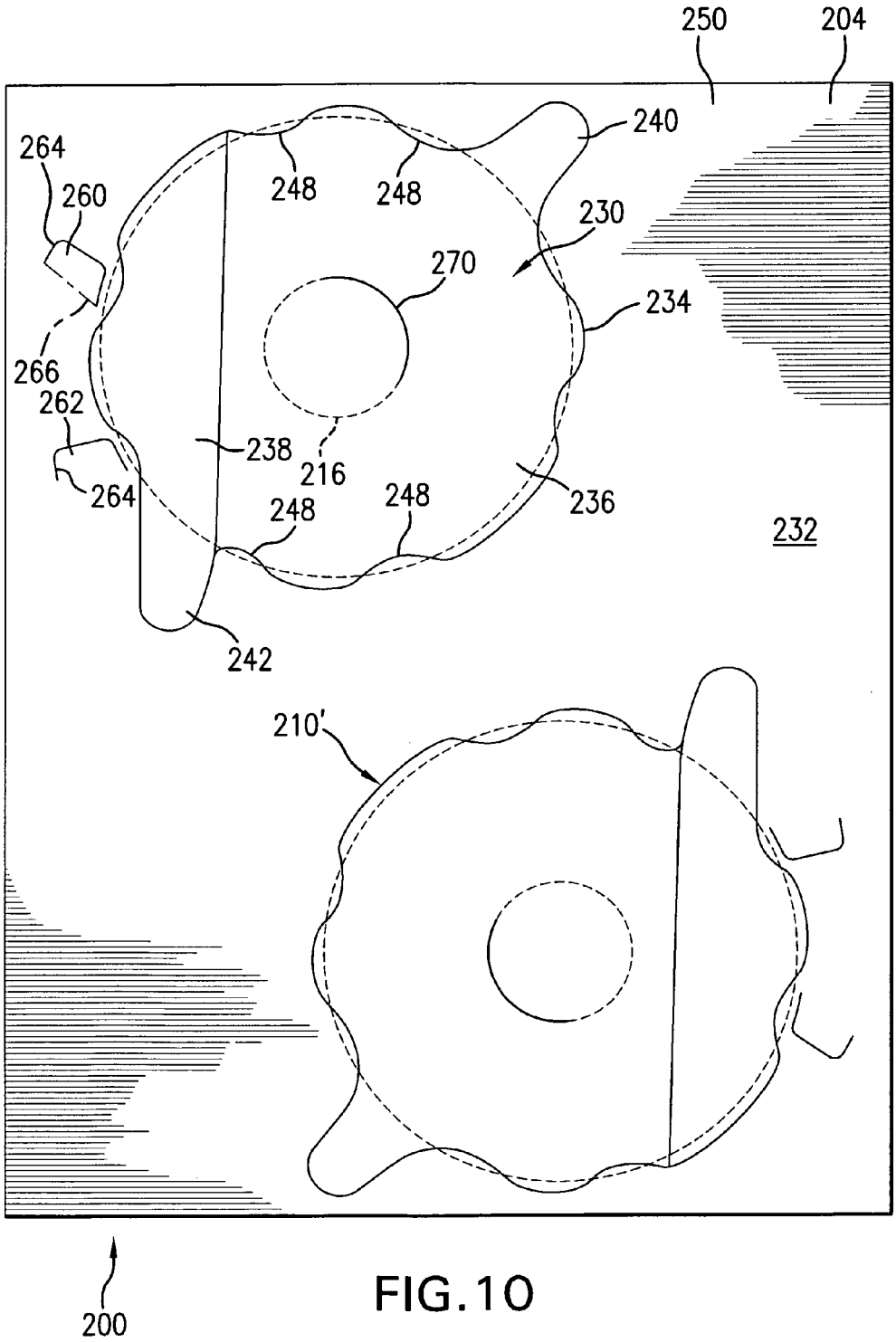
FIG. 10 is a plan view of the back side of the label assembly of FIG. 9.

FIGS. 9 and 10 show a label assembly 200 (not necessarily shown to scale) according to another embodiment of this invention. Label assembly 200 is desirably formed of a face sheet 202 having a printable surface, shown in the view of FIG. 9, and a back sheet 204, shown in the view of FIG. 10. The back sheet 204 is desirably about the same size as the face sheet 202, but may be slightly larger or smaller than the face sheet 202. The surface of the face sheet 202 that is disposed toward the back sheet 204, and opposite the printable surface, includes an adhesive material coating.

The label assembly 200 shown in FIGS. 9 and 10 includes two circular label shapes 210 and 210', which will be described herein with reference to label shape 210. The circular label shape 210 is defined in the face sheet 202 by a first tearable line of separation 212. The circular label shape 210 desirably has a diameter matched to, and preferably slightly smaller than, the diameter of a CD or DVD.

The label assembly 200 further includes a circle 216 cut within the face sheet 202 by a second tearable line 218 and positioned within the label shape 210, preferably positioned in a center position of the label shape 210. The second, smaller circle 216 is desirably approximately equivalent to either a diameter of an inner cut-out circle of the CD or DVD, or a diameter of an inner circle on the CD or DVD where a read/write portion of the CD or DVD adjoins a non-read/write portion of the CD or DVD. The area of label shape 210 between the two tearable lines 212 and 218 can be drawn upon, typed upon, or otherwise printed upon, such as when the sheet 200 is run through a printer, and can then be separated from the back sheet 204 to which the label shape 210 initially adheres. The label shape 210 can then be adhered to a non-read/write side of, for example, a CD or DVD.

The back sheet 204 includes a removable panel 230 defined in the back sheet surface 232 by at least one tearable line of separation 234. The removable panel 230 is disposed over the label shape 210, and as shown in FIGS. 9 and 10, is preferably generally coextensive the label shape 210. In the embodiment shown in FIGS. 9 and 10, the removable panel 230 is optionally divided into two sub-panels 236 and 238, which can assist in applying the label shape 210 to an object, for example, by allowing for only a portion of the removable panel 230 to be removed prior to a first adhesion of the label shape 210 to the object.

According to one preferred embodiment of this invention, the removable panel 230 includes two removal tabs 240 and 242 extending from a periphery of the back sheet removable panel 230. Removal tabs 240 and 242 are desirably positioned on opposing sides of the removable panel 230, such as shown in FIGS. 9 and 10. Removal tabs 240 and 242 are preferably shaped in such a manner so as to facilitate peeling away of removable panel 230. In this embodiment, removal tab 240 is associated with sub-panel 236 and removal tab 242 is associated with sub-panel 238. As will be appreciated, the different angling of removal tab 242, as compared to the angle of removal tab 240, facilitates the removal of the relatively narrow sub-panel 238. The back sheet 204 also includes a plurality of retainer tabs 248 extending from a remaining portion 250 and adhering to the label shape 210. As discussed above, the retainer tabs 248 are particularly useful in holding the label shape 210 in place (and attached to the remainder of the front sheet 202) while removing the removable panel 230 to expose the adhesive material on the label shape 210.

The label assembly 200 includes a registration structure, embodied in FIGS. 9 and 10 as two spaced apart registration tabs 260 and 262, aligned with the label shape 210. As will be described in more detail below, the registration structure of this embodiment allows for improved and easier application of a label to an object, for example, a CD or DVD. The tabs 260 and 262 are each defined on three sides by a tearable line of separation 264 in both the back sheet 204 and the face sheet 202. The tabs 260 and 264 are raisable to an extended position by folding outward above the back sheet 204. In FIG. 10, fold line 266 shows where the tab 260 will desirably be folded, and can be imaginary or a perforated or otherwise scored fold line.

According to one preferred embodiment of this invention, when the removable panel 230 is peeled away or otherwise removed from label shape 210, a center hole in label shape 210 is opened by the removal of the portion of the label assembly 200 within circle 216. In the embodiment of this invention shown in FIGS. 9 and 10, the center hole of label shape 210, defined by circle 216, may be opened upon removal of the removable panel sub-panel 236 using a die cut 270 extending partially along a perimeter of the circle 216 and in both face sheet 202 and back sheet 204. A similar use of such a die cut is described in commonly assigned U.S. Pat. No. 6,881,461, herein incorporated by reference.

The die cut 270 is preferably generally arcuate and positioned along a side of the circle 216 that corresponds with a side of the first circle 216 that is removed first. As shown in FIG. 10, the die cut 270 is disposed on the side of circle 216 toward the removal tab 240. According to an embodiment of die cut 270 having an arcuate shape, the arc preferably extends between approximately 1° and 180° along the circle 216 and more preferably extends between approximately 5° and 90° along the circle 216. Alternative designs for facilitating the removal of the portion of the label assembly 200 within circle 216 are also available for use in this invention.

Figure 11:
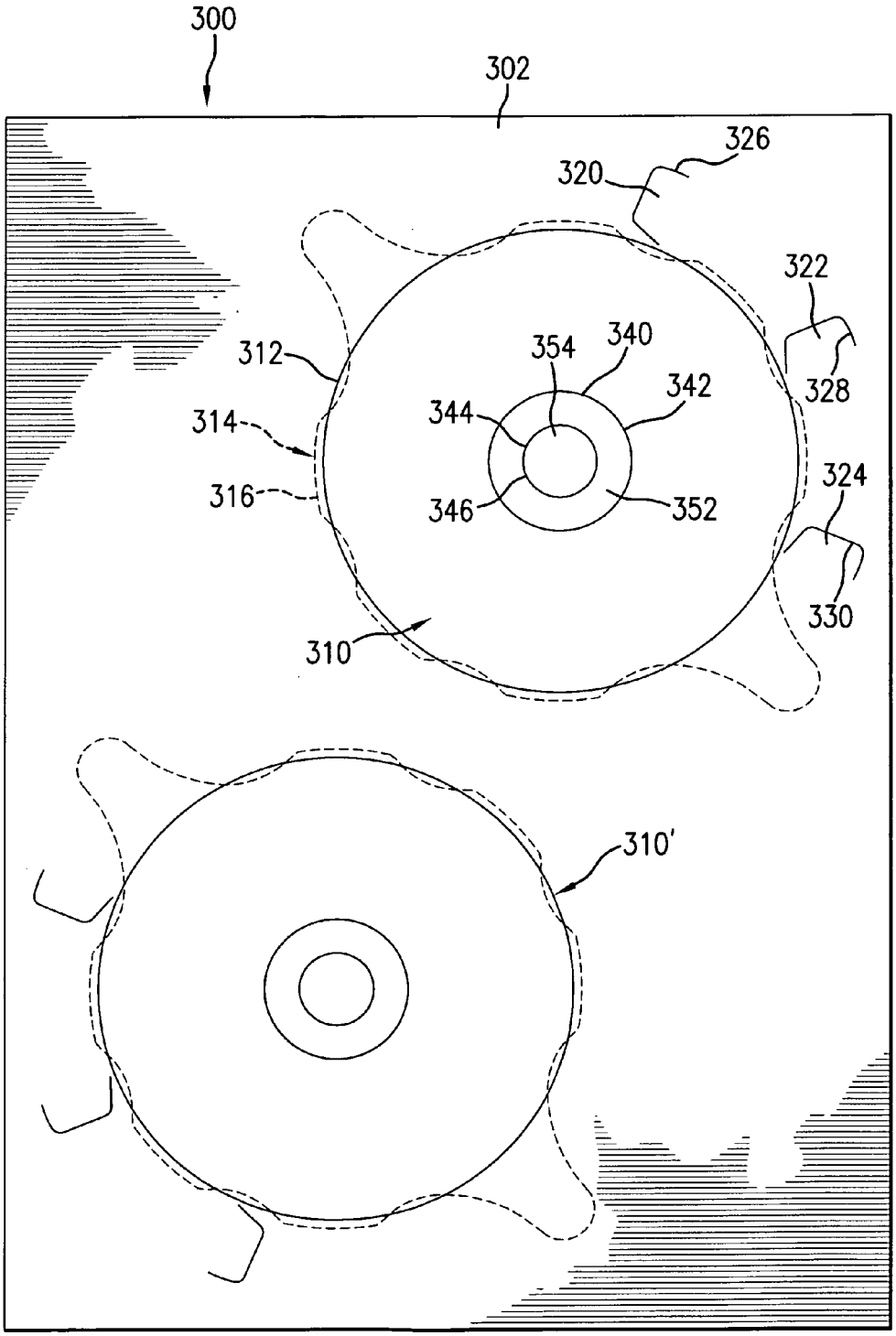
FIG. 11 is a plan view of a label assembly according to yet another embodiment of this invention.
Figure 12:
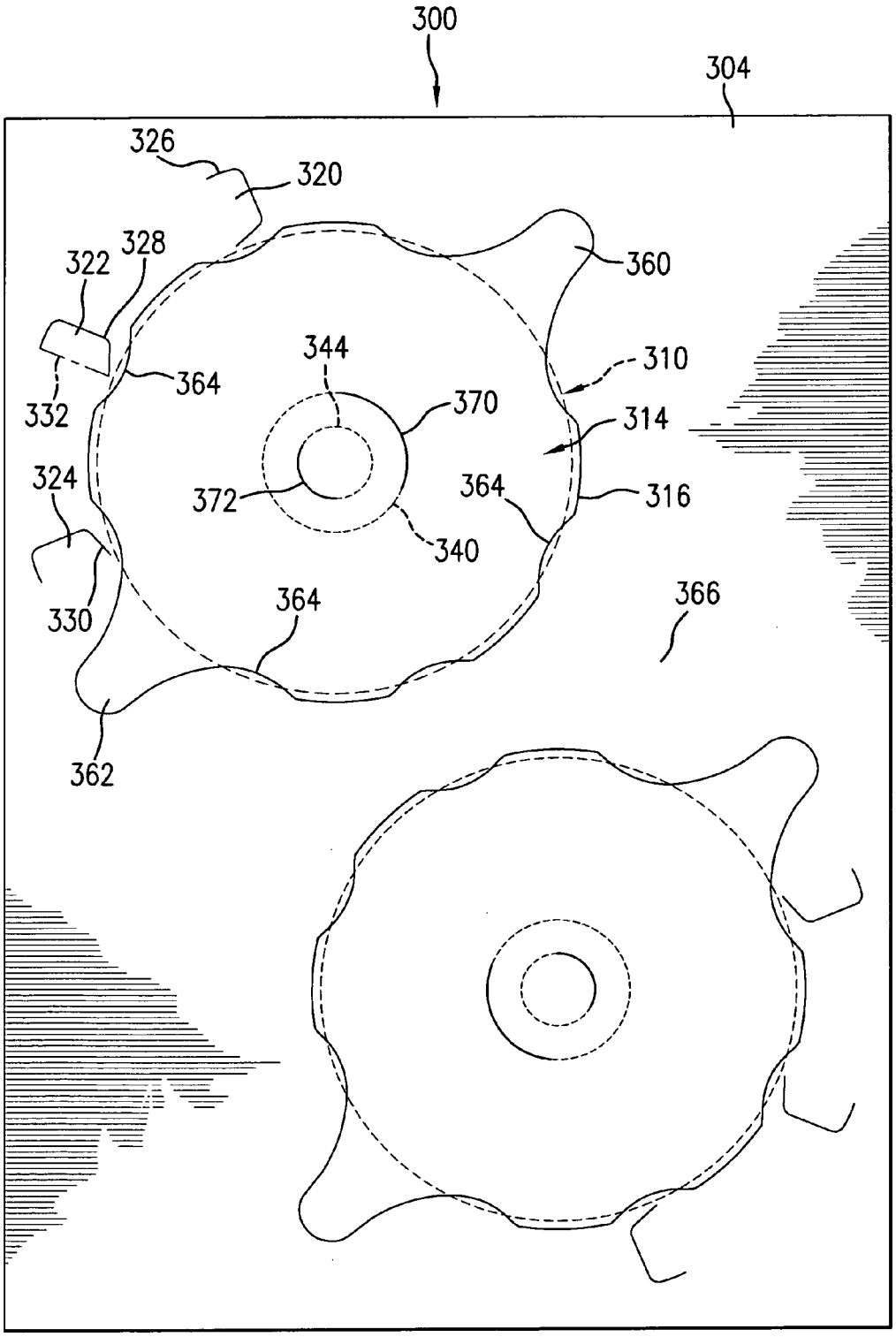
FIG. 12 is a plan view of the back side of the label assembly of FIG. 11.

FIGS. 11 and 12 illustrate a label assembly 300 according to yet another embodiment of this invention. The label assembly 300 includes a front sheet 302 having a printable surface and an adhesive material coating a surface opposite the printable surface. A back sheet 304 is disposed over the adhesive material.

Two label shapes 310 and 310' are defined in the face sheet 302, and will be discussed herein with reference to label shape 310. Circular label shape 310, appropriately sized for use in labeling a CD or DVD, is defined in the face sheet by a tearable line of separation 312. A removable panel 314 is defined in the surface of the back sheet 304 by a tearable line of separation 316, and is disposed over the label shape 310.

The label assembly 300 includes a registration structure aligned with the label shape 310 and the removable panel 314. In the embodiment of FIGS. 11 and 12, the registration structure includes three spaced apart registration tabs 320, 322, and 324, each defined on three sides by a tearable line of separation 326, 328, and 330, respectively, in both the back sheet 304 and the face sheet 302. The registration tabs 320, 322, and 324 are raisable above the back sheet by folding outward, such as about the fold line 332.

A first circle 340 is cut within the face sheet 302 by a tearable line of separation 342 and positioned within the label shape 310. A second circle 344 is also cut within the face sheet 302 by a tearable line of separation 346, and nested within a first perimeter of the first circle 340. A plurality of nested circular removable label shapes 310, 352, and 354 are thus located within the circle formed by tearable line 312. As discussed above, the ring-shaped removable label shape 310 formed between tearable lines 312 and 342 can be adhered to a non-read/write side of the read/write portion of a CD or DVD as a label. Similarly, the ring-shaped removable shape 352 formed between tearable lines 342 and 346 can be adhered to the small non-read/write portion of a CD or DVD as a label. The removable shape 354 is desirably sized to leave an opening that corresponds to the center opening of a CD or DVD.

Various and alternative sizes, shapes, and configurations are available for the removable label shapes of this invention. For example, label shapes 310, 352, and 354 are preferably but not necessarily ring-shaped or circular, as label shapes 310, 352, and 354 can also have any polygonal shape or any other suitable non-circular shape. As another example, an optional further ring-shaped portion (not shown) can be formed between shapes 310 and 352 to serve as a discardable spacer.

The back sheet removable panel 314 includes two removal tabs 360 and 362 extending from a periphery of the removable panel 314. Removal tabs 360 and 362 are desirably positioned on opposing sides of the removable panel 314. As discussed above, removal tabs 360 and 362 are preferably shaped in such a manner so as to facilitate peeling away of removable panel 314. The back sheet 304 also includes a plurality of retainer tabs 364 extending from a back sheet remaining portion 366 and adhering to the label shape 310. The retainer tabs 364 assist in holding the label shape 310 in place, e.g., and attached to the remainder of the front sheet 202, while removing the removable panel 314 to expose the adhesive material on the back side of the label shape 310. In the embodiment shown in FIGS. 11 and 12, each of the spaced apart registration tabs 320, 322, and 324 is aligned with one of the plurality of retainer tabs 364.

According to one preferred embodiment of this invention, when the removable panel 314 is peeled away or otherwise removed from label shape 310, a center hole in label shape 310 is opened by the removal of either only label shape 354 or both label shapes 352 and 354. In the embodiment shown in FIGS. 11 and 12, whether only shape 354 is removed with the removable panel 314 or both shapes 352 and 354 are removed with the removable panel 314 is controlled by which of removal tabs 360 and 362 is used to remove the removable panel 314.

The label assembly 300 includes a first die cut 370 extending in a first arc partially along a perimeter of the first circle 340 and in the face sheet 302 and the back sheet 304. A second die cut 372 extends in a second arc partially along a perimeter of the second circle 344 and in the face sheet 302 and the back sheet 304. Both the first and second arcs extend between approximately 1° and 180°, and more desirably between approximately 5° and 90°, along the first and second circles 340 344, respectively. The first arc die cut 370 is disposed on a side of the first circle 340 toward the first removal tab 360.

The second arc die cut 372 is disposed on a side of the second circle 344 toward the second removal tab 362.

Removing the removable panel 314 by grasping removal tab 360 and peeling removable panel 314 from the back sheet 304 (generally in a direction toward the opposing tab 362) results in removal of both label shapes 352 and 354 from the front sheet 302. The die cut 370 desirably causes the label shapes 352 and 354 to continue adhering to the removable panel 314 and to separate (along tearable line 342) from the front sheet 302. Removing the removable panel 314 by grasping the second removal tab 362 and peeling removable panel 314 from the back sheet 304 (generally in a direction toward the opposing tab 360) desirably results in removal of only label shape 354 from the front sheet 302. As there is not die cut like die cut 370 in this direction along the perimeter of circle 340, the shape 352 remains attached to the front sheet 302. The die cut 372 causes the label shape 354, however, to continue adhering to the removable panel 314 and to separate (along tearable line 344) from the front sheet 302. Thus the label assembly user can choose between two alternative shapes of label shape 310, i.e., one version keeping the shape portion 352 attached to cover more surface of the CD or DVD, or a second version without the shape portion 352.

The invention further provides a method for labeling an object using the label assembly, such as label assembly 300. First, the label assembly user routes the label assembly 300 through a printer to print the desired text and/or graphic on the printable surface of label shape 310. The label assembly 330 is desirably placed on a flat hard surface with the printed face sheet 302 downward. The user removes the removable panel 314 using one of the two opposing removal tabs 360 or 362 to expose the adhesive material on the label shape 310. The user raises the registration structure by breaking the tearable lines 326, 328 and 330 and folding the registration tabs 320, 322, and 324 above the surface of the back sheet 304. The user then places the object against the registration tabs 320, 322, and 324 and then lowers the object to adhere the label shape 310 to the object.

Figure 13:
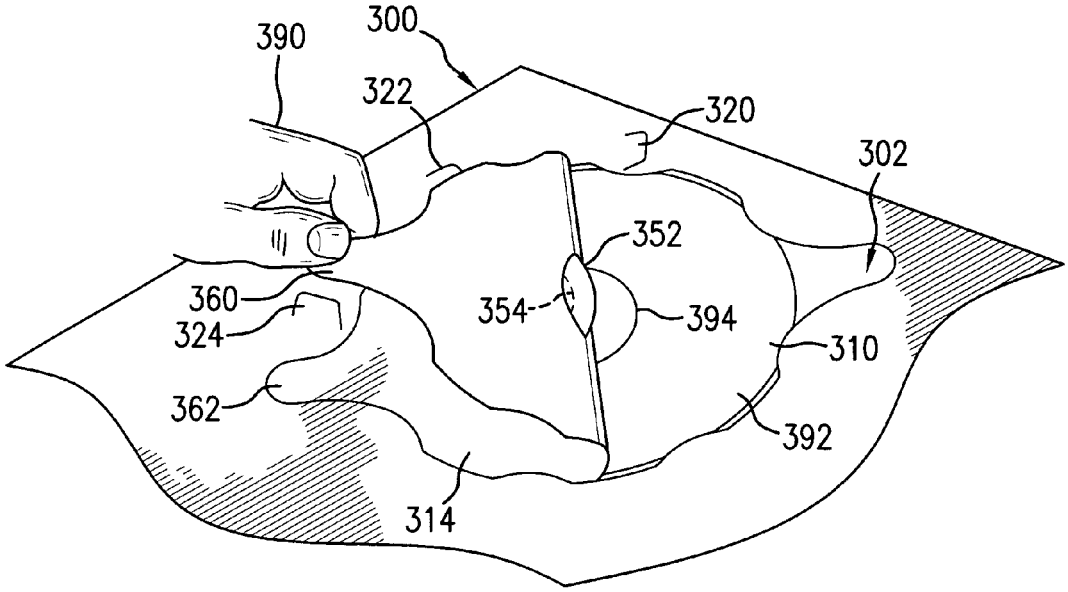
FIGS. 13 and 14 illustrate an operation of the label assembly of FIGS. 11 and 12.
Figure 14:
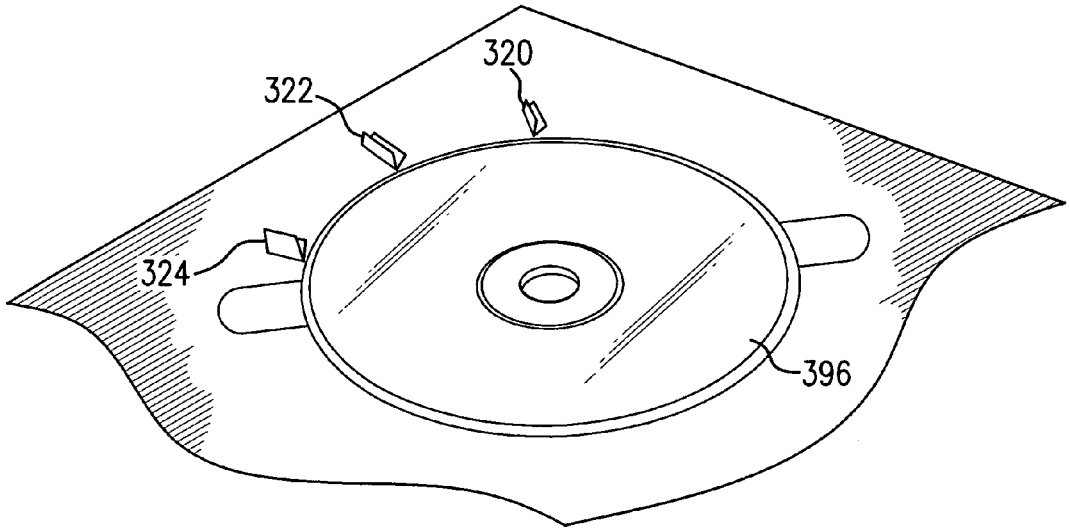

FIGS. 13 and 14 illustrate the use of the label assembly 300. In FIG. 13, the user 390 is peeling the removable panel 314 from the back sheet 304 to expose the adhesive coated side 392 of the label shape 310. The user 390 is peeling by grasping removal tab 360, and thus both label shapes 352 and 354 are removed from the front sheet 302 and stay adhered to the removable panel 314 to provide an opening 394 in label shape 310.

In FIG. 14, the registration tabs 320, 322, and 324 are folded upward, the removable panel 314 is fully removed, and compact disc 396 is placed against the registration tabs 320, 322, and 324 and on the adhesive side of the label shape 310. Placing the compact disc 396 against registration tabs 320, 322, and 324 facilitates proper alignment of the compact disc 396 over the label shape 310, thereby promoting the desired placement of the label shape 310 on the compact disc 396 without a separate label application apparatus. The labeled compact disc 396 can then simply be lifted from the label assembly 300.

Figure 15:
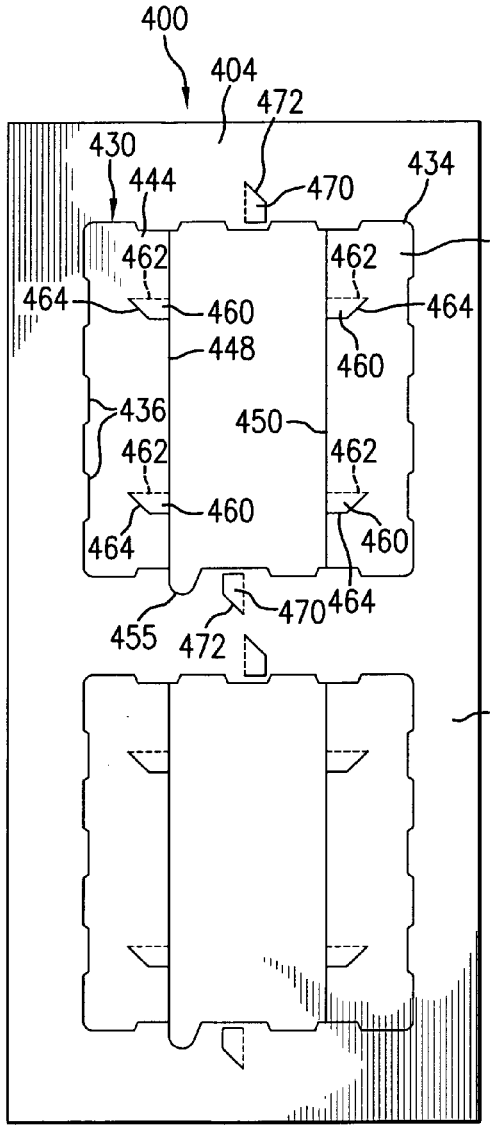
FIGS. 15 and 16 are plan views of a label assembly according to yet another embodiment of this invention.
Figure 16:
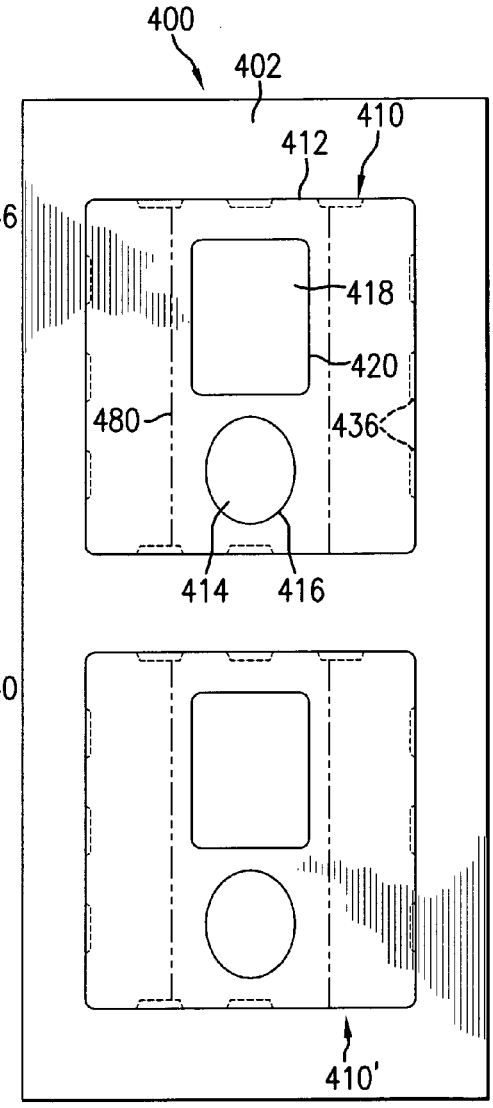

FIGS. 15 and 16 show the back and front, respectively, of a label assembly 400 according to another embodiment of this invention. Label assembly 400 includes a face sheet 402 having a printed or printable surface, shown in the view of FIG. 16, and an adjacent back sheet 404, shown in the view of FIG. 15. The back sheet 404 is desirably about the same size as the face sheet 402, but may be slightly larger or smaller than the face sheet 402. The surface of the face sheet 402 that is disposed toward the back sheet 404, and opposite the printed or printable surface, includes an adhesive material coating.

The label assembly 400 shown in FIGS. 15 and 16 includes a plurality of label shapes, and more particularly two label shapes 410 and 410'. The two label shapes 410 and 410' can be the same or have different sizes and/or printed patterns, and will be described herein with reference to label shape 410.

The label shape 410 is defined at an outer periphery by a tearable line of separation 412. In the embodiment of the invention shown in FIGS. 15 and 16, the label shape 410 is particularly adapted to be applied to an object having a non-planar and/or more than one surface. The illustrated embodiment is particularly useful in aligning label shape 410 to an object having a planar surface wherein the label is to be applied to a front surface and also wrapped around a side or back surface. In one embodiment of this invention, the label assembly is particularly useful for labeling or personalizing objects having a three-dimensional box-like configuration, including, without limitation, personal electronics such as cell phones, PDAs, digital cameras, netbooks or MP3 players, and also any other objects such as credit cards, RF or SIM chip cards, picture frames, photo or keepsake boxes, jewelry boxes, toy cases, etc.

Figure 20:
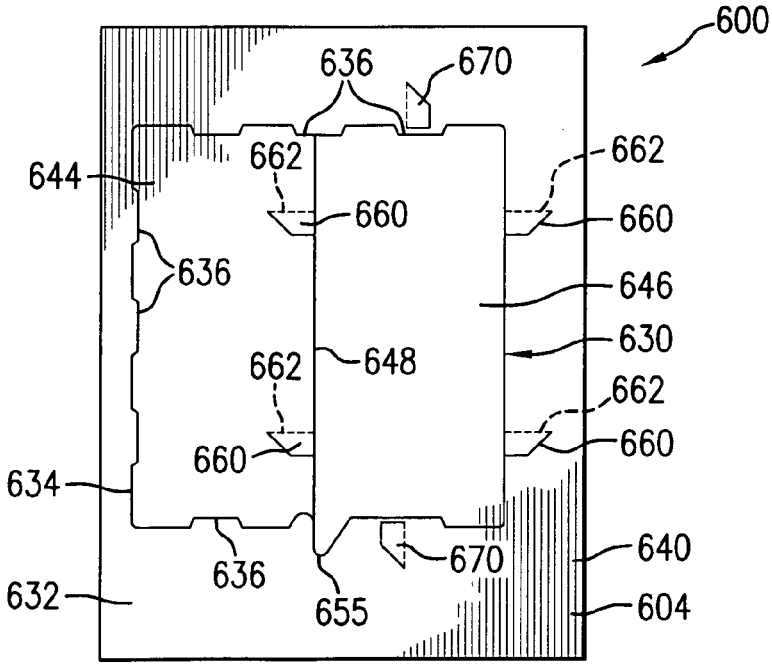

In the embodiment of FIGS. 15 and 16, label shape 410 is configured to be applied to an IPOD® music player, although changes in the size, shape and configuration of the label shape can be made to accommodate other objects. Label shape 410 includes additional shapes defined within the periphery by additional tearable lines of separation. The label shape 410 includes a circle 414 cut within the face sheet 402 by a second tearable line of separation 416 and a rectangular shape 418 cut within the face sheet 402 by a third tearable line of separation 420. As can be seen in FIG. 15, these lines of separation 416 and 420 are cut only in the face sheet 402 and correspond to the control mechanism and view screen of the music player, such as shown in the embodiment of FIG. 20.

The back sheet 404 includes a removable panel 430 defined in the back sheet surface 432 by at least one tearable line of separation 434 extending around the outer periphery of removable panel 430. The removable panel 430 is disposed over the label shape 410, and as shown in FIGS. 15 and 16, is preferably generally coextensive with label shape 410. The back sheet 404 also includes a plurality of retainer tabs 436 extending from a remaining portion 440 surrounding the removable panel 430 and adhering to the label shape 410. As discussed above, the retainer tabs 436 are particularly useful in holding the label shape 410 in place (and attached to the remaining portion 438 of the front sheet 402) while removing the removable panel 430 to expose the adhesive material on the label shape 410.

In one embodiment of this invention, such as shown in FIGS. 15 and 16, the removable panel 430 is divided into at least two sub-panels, which can assist in applying the label shape 410 to an object, for example, by allowing for only a portion of the removable panel 430 to be removed prior to a first adhesion of the label shape 410 to the object and the subsequent removal or a second panel for wrapping the additional portion of the label shape 410 around a different surface (e.g., a side and/or back surface) of the object. In the embodiment of this invention shown in FIG. 15, the removable panel 430 includes a center panel portion 442 between two side panel portions 444 and 446. The center panel portion 442 is divided from each of the side panel portions 444 and 446 by a corresponding line of separation 448 and 450, respectively, cut within the back sheet 404 only. The center panel portion 442 can also include the optional corner starter flap, or removal tab, 455 that is adapted to allow for easier removal of the center panel portion 442 by the user. The side panel portions can also optionally include such removal tabs.

The label assembly 400 includes a registration structure, embodied in FIGS. 15 and 16 as four spaced apart registration tabs 460 aligned with a portion of the label shape 410. As described above, the registration structure of this embodiment also allows for improved and easier application of a label to an object, for example, an MP3 player. The tabs 460 are each defined on three sides by one or more tearable lines of separation in the back sheet 404. The tabs 460 are raisable to an extended position by folding outward above the back sheet 404. In FIG. 15, fold line 462 shows where the tab 460 will desirably be folded, and can be imaginary or a perforated or otherwise scored fold line.

In the embodiment shown in FIGS. 15 and 16, the registration structure is positioned within an outer periphery of the removable panel 430 and defined in only the back sheet 404. More particularly, at least one, and desirably each, of the two side panel portions 444 and 446 includes one or more of the registration tabs 460. The registration tabs 460 are disposed adjacent to and along an edge of the center panel portion 442. In one embodiment of this invention, the registration tabs 460 are defined on a side adjacent to the center panel portion 442 by the lines of separation 448 and 450, respectively, that are defining the center panel portion 442. The tabs 460 are each defined on the remaining sides by tearable line of separation 464.

Upon removing the center panel portion 442, the object to be labeled can be aligned over the adhesive area that is under the center panel portion 442 using the raised registration tabs 460. The label assembly 400 further includes an optional alignment structure aligned with a portion of the label shape 430 and also one of raised or raisable above the back sheet. In the embodiment shown in FIGS. 15 and 16, the alignment structure includes two alignment tabs 470 each defined by a tearable line of separation 472 and positioned external of the outer periphery of the removable panel 430. The tearable lines of separation 472 can be cut within the back sheet 402 or both the front sheet 402 and the back sheet 404 as they are positioned external of the removable panel 430.

The invention further includes a method for labeling an object with a label from the label assembly 400. As discussed above, label assembly 400 can be pre-printed or printable. If the label assembly is printable, the consumer can print custom images or text on the printable surface of the face sheet 402 with a printer prior to labeling an object. The printed label assembly 400 is placed on a surface with the face sheet 402 downward on the surface. The center panel portion 442 of the removable panel 430 is removed, such as by using starter flap 455, to expose the adhesive material on a first portion of the label shape 410. The registration tabs 460 and the alignment tabs 470 are raised either before or after the center panel portion 442 is removed. A surface of the object (not shown) is placed over the adhesive material and kept in proper alignment using the tabs 460 and 470. A portion of label shape 410 is adhered to the object surface by placing the object on the exposed adhesive material while the object is against the tabs 460 and 470. Once the object surface is adhered, the side panels 444 and 446 can be removed to expose the adhesive material on the remaining label shape 410. The side portions of the label shape 410 are then applied to the object, for example, by folding the side portions of the label shape 410 along fold lines 480 to wrap the side portions around side and/or back surfaces of the object.

In an alternative embodiment, the object is placed on the surface and the label assembly is placed over the object for labeling the object. In such an embodiment, the tabs 460 and 470 can be preferably sized according to a height of the object on the surface, to hold the label shape just over the object. The label shape can then be applied by pressing down on the label shape.

The invention also includes software for printing on the label shape. The software is executable on a data processor attached to a printer and includes templates for allowing the user to apply text or images in the desired location on the label shape (e.g., to avoid the view screen area). The software can include, on a recordable medium, numerous templates each corresponding to one label shape for a known consumer device.

Figure 17:
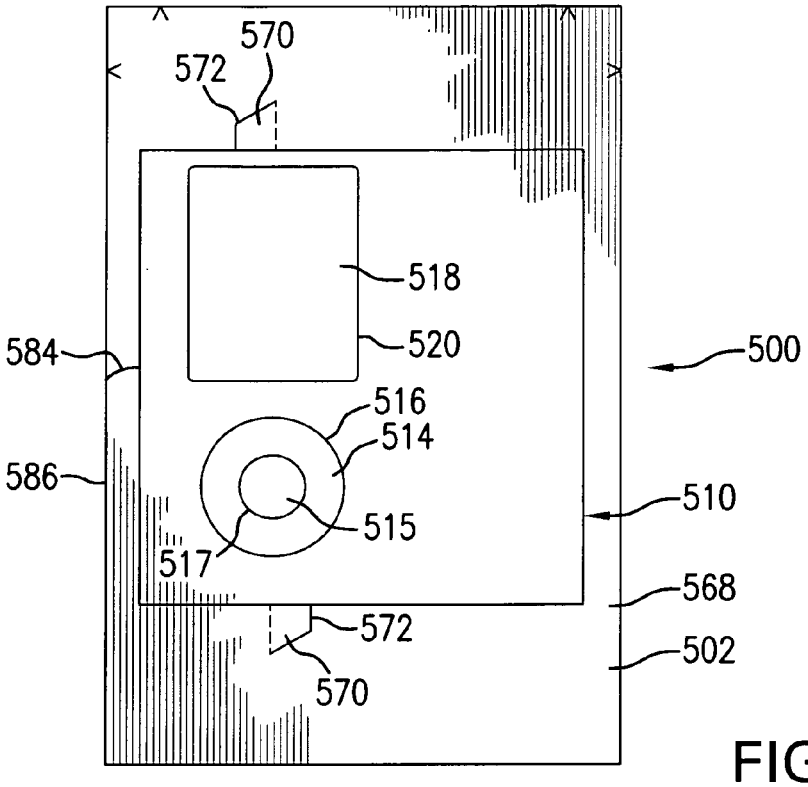
FIGS. 17 and 18 are plan views of a label assembly according to yet another embodiment of this invention.
Figure 18:
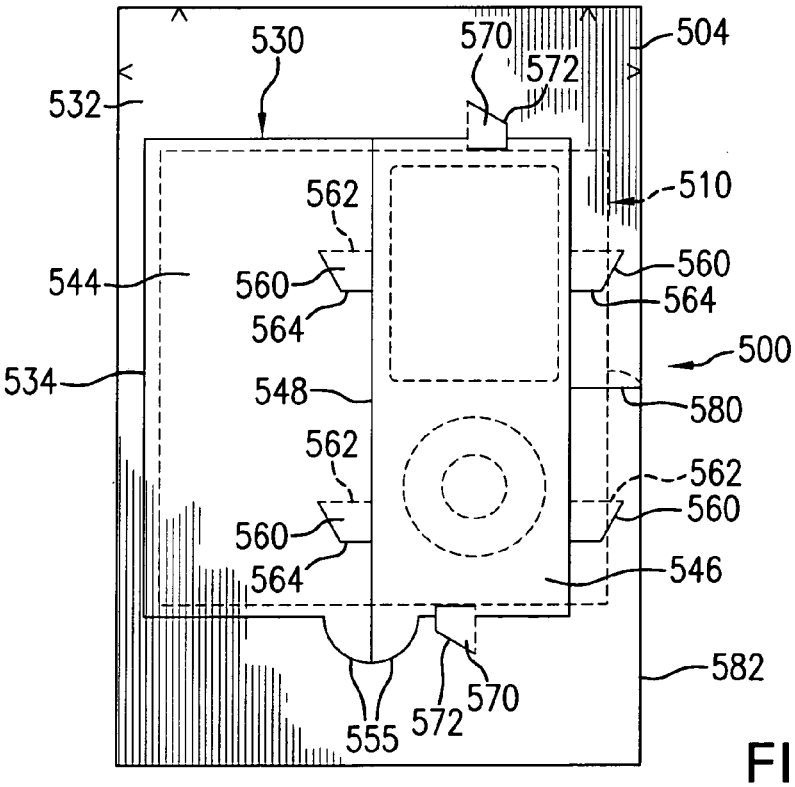

FIGS. 17 and 18 show the front and back, respectively, of a label assembly 500 according to another embodiment of this invention. Label assembly 500 includes a face sheet 502 having a printed or printable surface, shown in the view of FIG. 17, and an adjacent back sheet 504, shown in the view of FIG. 18. The surface of the face sheet 502 that is disposed toward the back sheet 504, and opposite the printed or printable surface, includes an adhesive material coating.

The label assembly 500 shown in FIGS. 17 and 18 includes a single label shape 510, but could alternatively include two or more. The label shape 510 is defined at an outer periphery by a tearable line of separation 512. In the embodiment of the invention shown in FIGS. 17 and 18, the label shape 510 is also particularly adapted to be applied to an object having non-planar or more than one surface. The illustrated embodiment is particularly useful in aligning label shape 510 to an object having a planar surface wherein the label is to be wrapped around a side or back surface. As discussed above for FIGS. 15 and 16, label shape 510 is shown as a label suitable for a current IPOD® music player, but the application means of the embodiment of FIGS. 17 and 18 could be applied using other sizes and shapes of label shapes for other devices, such as consumer electronics or and any other object.

As shown in FIG. 17, the label shape 510 includes additional shapes defined within the periphery by additional tearable lines of separation. The label shape 510 includes two circles 514 and 515 cut within only the face sheet 502 by tearable lines of separation 516 and 517, respectively, which coordinate to the click-wheel and button of the IPOD® player. A rectangular shape 518 is also cut within the face sheet 502 by a tearable line of separation 520 and corresponds to the view screen of the IPOD® player. The tearable lines of the face sheet 502 are shown in phantom in FIG. 18 to illustrate the positioning with the tearable lines and panels of the back sheet 504.

Referring to FIG. 18, the back sheet 504 includes a removable panel 530 defined in the back sheet surface 532 by at least one tearable line of separation 534 extending around the outer periphery of removable panel 530. The removable panel 530 is disposed over a portion, e.g., a majority, of the label shape 510. The removable panel 530 is not exactly coextensive with label shape 510 and extends beyond the label shape 510 on three sides and the label shape 510 extends beyond the removable panel 530 on the fourth side.

The removable panel 530 is divided into two sub-panels, which can assist in applying the label shape 510 to an object, for example, by allowing for only a portion of the removable panel 530 to be removed prior to a first adhesion of the label shape 510 to the object and the subsequent removal or a second panel for wrapping the additional portion of the label shape 510 around a different surface (e.g., a side and/or back surface) of the object. In the embodiment of this invention shown in FIG. 18, the removable panel 530 includes two panel portions 544 and 546. The panel portions 544 and 546 are divided from each other by a line of separation 548, cut within the back sheet 504 only. The panel portions 544 and 546 each include an optional corner starter flap, or removal tab, 555 that is adapted to allow for easier removal of the panel portions 544 and 546 by the user.

The label assembly 500 includes a registration structure, embodied in FIG. 18 as four spaced apart registration tabs 560 aligned with a portion of the label shape 510. The tabs 560 are each defined on three sides by one or more tearable lines of separation in the back sheet 504. The tabs 560 are raisable to an extended position by folding outward above the back sheet 504. In FIG. 18, fold lines 562 show where the tab 560 will desirably be folded, and can be imaginary or a perforated or otherwise scored fold line.

In the embodiment shown in FIG. 18, a portion of the registration structure is positioned within an outer periphery of the removable panel 530 and defined in only the back sheet 504. More particularly, the side panel portion 544 includes two of the registration tabs 560. The registration tabs 560 of side panel portion 544 are disposed adjacent to and along an edge of the other panel portion 546. In this embodiment of this invention, the additional two registration tabs 560 are positioned external of the outer periphery of the removable panel 530 and on an opposite side of the side panel portion 546 from side panel portion 544. However, in this embodiment all tabs 560 are cut only in the back sheet 504, as the label sheet 510 extends over at least a portion of each of the tabs 560. Each of the registration tabs 560 is defined on a side adjacent to the panel portion 546 by the line of separation 548 and 534, respectively. The tabs 560 are defined on the remaining sides by tearable line of separation 564.

Upon removing the panel portion 546, the object to be labeled can be aligned over the adhesive area that is under the panel portion 546 using the raised registration tabs 560. The label assembly 500 further includes an optional alignment structure aligned with a portion of the label shape 530 and also one of raised or raisable above the back sheet. The alignment structure includes two alignment tabs 570 defined by a tearable line of separation 572 and positioned external of the outer periphery of the removable panel 530. The tearable line of separation 572 can be cut within the back sheet 504 or both the front sheet 502 and the back sheet 504 as shown in FIGS. 17 and 18, as they are positioned external of the removable panel 530 and label shape 510.

In one embodiment of this invention, the label assembly 500 includes a removal facilitation structure for aiding the user in removing the matrix 568 from the label sheet 510 upon adhering an object to the panel portion 546. As shown in FIGS. 17 and 18, the removal facilitation structure includes a die cut 580 in the back sheet 504 extending between the removable panel 530 and an outer edge 582 of the back sheet 504. The die cut 580 is used in cooperation with a die cut 584 in the front sheet 502 that extends from the label shape 510 to an edge 586 of the front sheet 502. Preferably, the die cut 580 and the die cut 584 are at least partially offset from each other to help maintain the matrix 568 connection until torn by the user. In the embodiment shown in FIGS. 17 and 18, the die cut 584 is curved and intersects with the die cut 580 at the edge 586 of the face sheet 502.

The label assembly 500 is used in a similar manner as the label assembly 400 discussed above. If the label assembly 500 is to be printed upon, the user feeds the label assembly 500 through a suitable printer. To facilitate printing the tabs 560 have the fold lines 562 disposed toward the printing feed direction to reduce the chance of the tabs 560 being raised during printing.

Either the object to be labeled or the label assembly 500 is placed on a surface. The panel portion 546 is removed and the tabs 560 and 570 are raised. When the label assembly is placed face sheet down on the surface, the object is placed over the exposed adhesive material and kept in proper alignment using the tabs 460 and 470. Alternatively, the label assembly 500 with the removed panel portion 546 can be placed from above onto an object placed on a surface. The tabs 460 and 470 align the label shape 510 over the object as the label assembly 500 is lowered onto the object. The tabs 560 and 570 can act as legs to stand the label assembly over the object until the user pats the exposed adhesive against the object to adhere the label shape 510 to the object. Desirably, the tabs are appropriately sized to a thickness of the object.

Once the label shape 510 is partially adhered to the object, the other panel portion 544 is removed, and the matrix is removed from the label shape 510. The removal of the matrix is facilitated by the user separating die cuts 580 and 584 and tearing the matrix from around label shape 510. The label shape can then be wrapped around the object. Where the object has rounded sides, such as an IPOD®, the object can be rolled on the label shape 510 on the flat surface to adhere the additional portions of the label shape to the object. Desirably the edges of the wrapped label sheet meet end to end, but overlap or a gap are also possible.

Figure 19:
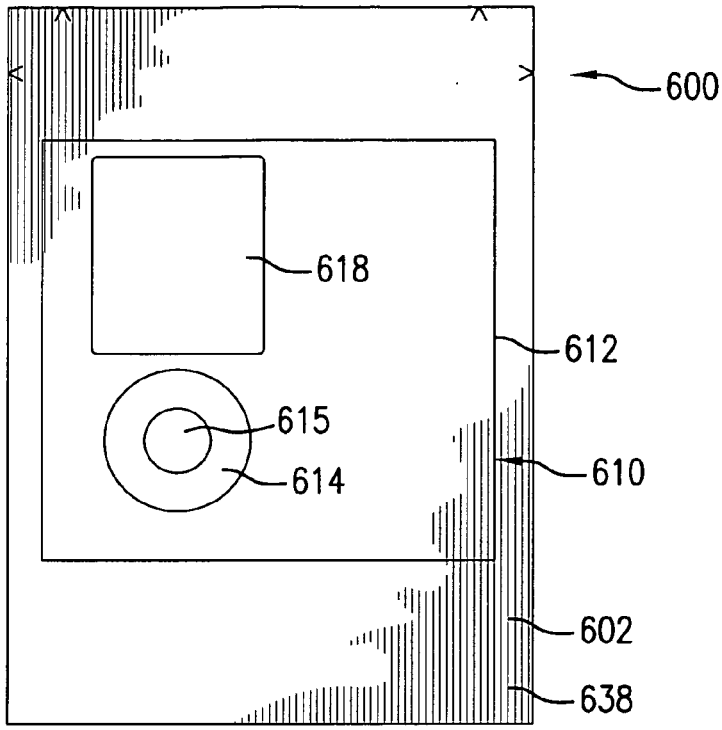
FIGS. 19 and 20 are plan views of a label assembly according to still yet another embodiment of this invention.

FIGS. 19 and 20 show the front and back, respectively, of a label assembly 600 according to another embodiment of this invention. Label assembly 600 is a variation of the label assembly 500 shown in FIGS. 17 and 18. Label assembly 600 includes a face sheet 602 having a printed or printable surface, shown in the view of FIG. 19, and an adjacent back sheet 604, shown in the view of FIG. 20. An adhesive material is disposed between the face sheet 602 and the back sheet 604.

The label assembly 600 shown in FIGS. 19 and 20 includes a single label shape 610, but could alternatively include two or more. The label shape 610 is defined at an outer periphery by a tearable line of separation 612. In the embodiment of the invention shown in FIGS. 19 and 20, the label shape 610 is also particularly adapted to be applied to an object having non-planar or more than one surface. Label shape 610 is also shown as a label suitable for a current IPOD® music player, including two circles 614 and 615 cut within only the face sheet 602 which coordinate to the click-wheel and button of the IPOD® player, respectively, and rectangular shape 618 cut within the face sheet 602 to correspond to the view screen of the IPOD® player. The application means of the embodiment of FIGS. 19 and 20 could be applied using other sizes and shapes of label shapes for other devices, such as consumer electronics or and any other object.

In one embodiment of this invention, an arcuate die cut can be used as discussed above to facilitate removal of the circles 614 and/or 615 from label shape 610 if desired. If the center circle 615 is desired, but not the outer circle 614, an adhesive strip (such as a paper strip with a tacky but not permanent adhesive) or equivalent can be placed across the face sheet 602 and over the circles 614 and 615. When the removable panel 630 is removed, the outer circle 614 can be removed while the inner circle is held in place by the adhesive strip.

Referring to FIG. 20, the back sheet 604 includes a removable panel 630 defined in the back sheet surface 632 by at least one tearable line of separation 634 extending around the outer periphery of removable panel 630. In this embodiment of the invention, the removable panel 630 is generally coextensive with label shape 610 on three sides which include plurality of retainer tabs 636 extending on three sides from a remaining portion 640 surrounding the removable panel 630 and adhering to the label shape 610. As discussed above, the retainer tabs 636 are particularly useful in holding the label shape 610 in place (and attached to the remaining portion 638 of the front sheet 602) while removing the removable panel 630 to expose the adhesive material on the label shape 610. On the fourth side of label shape 610, the tearable line defining the periphery of the removable panel 630 is optionally offset from the tearable line defining the periphery of the label shape 610 to allow a portion of label shape 610 to be wrapped around one side of the object to be labeled.

The removable panel 630 is divided into two sub-panels, which can assist in applying the label shape 610 to an object, for example, by allowing for only a portion of the removable panel 630 to be removed prior to a first adhesion of the label shape 610 to the object and the subsequent removal or a second panel for wrapping the additional portion of the label shape 610 around a different surface (e.g., a side and/or back surface) of the object. In the embodiment of this invention shown in FIG. 20, the removable panel 630 includes two panel portions 644 and 646. The panel portions 644 and 646 are divided from each other by a line of separation 648, cut within the back sheet 604 only. One or both of the panel portions 644 and 646 can include an optional corner starter flap, or removal tab, 655 that is adapted to allow for easier removal of the panel portions 644 and/or 646 by the user.

The registration structure of the label assembly 600 includes four spaced apart registration tabs 660 aligned with a portion of the label shape 610. In this embodiment of the invention, the tabs 660 are each defined on three sides by one or more tearable lines of separation in only the back sheet 604. The tabs 660 are raisable to an extended position by folding outward above the back sheet 604 at perforated or otherwise scored fold lines 662.

Similar to the embodiment discussed above in FIGS. 17 and 18, a portion of the registration structure is positioned within an outer periphery of the removable panel 630 and defined in only the back sheet 604. More particularly, the side panel portion 644 includes two of the registration tabs 660. The registration tabs 660 of side panel portion 644 are disposed adjacent to and along an edge of the other panel portion 646. In this embodiment of this invention, the additional two registration tabs 660 are positioned external of the outer periphery of the removable panel 630 and on an opposite side of the side panel portion 646 from side panel portion 644. However, in this embodiment all tabs 660 are cut only in the back sheet 604, as the label sheet 610 extends over at least a portion of each of the tabs 660.

Upon removing the panel portion 646, the object to be labeled can be aligned over the adhesive area that is under the panel portion 646 using the raised registration tabs 660. The label assembly 600 further includes optional opposing alignment tabs 670 defined by a tearable line of separation 672 and positioned external of the outer periphery of the removable panel 630. In this embodiment, the tearable lines of separation 672 are cut only within the back sheet 602 because of the placement of the tabs 670 within corresponding retainer tabs 636. Alternative configurations could allow for the tabs 670 to be cut within both of the front sheet 602 and back sheet 604 for extra rigidity. The label assembly 600 is used in a similar manner as the label assembly 500 discussed above.

Figure 22:
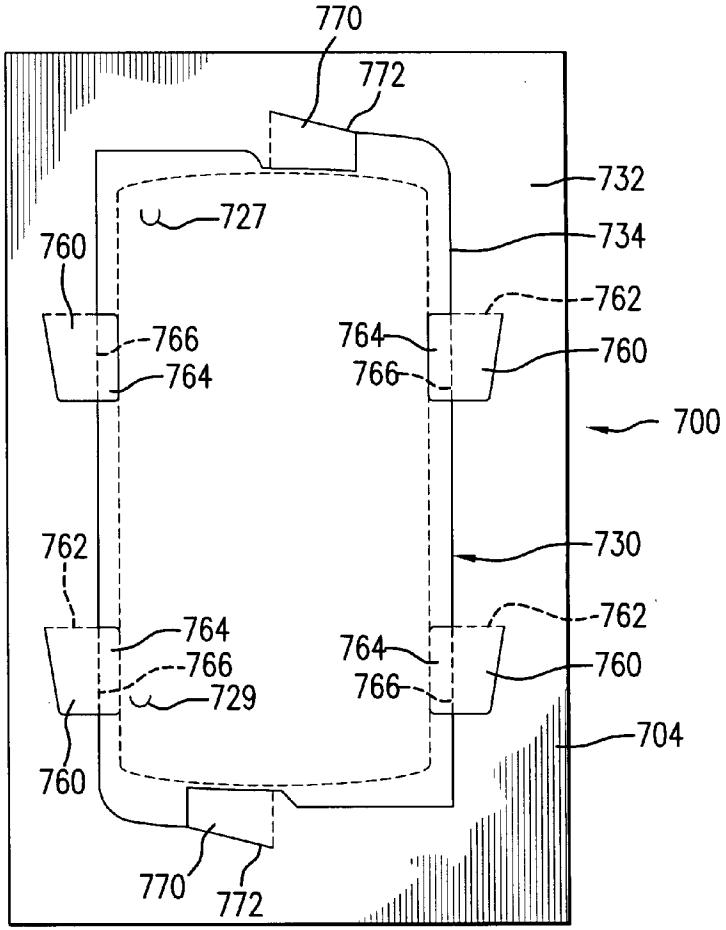
FIGS. 21 and 22 are plan views of a label assembly according to yet another embodiment of this invention.
Figure 21:
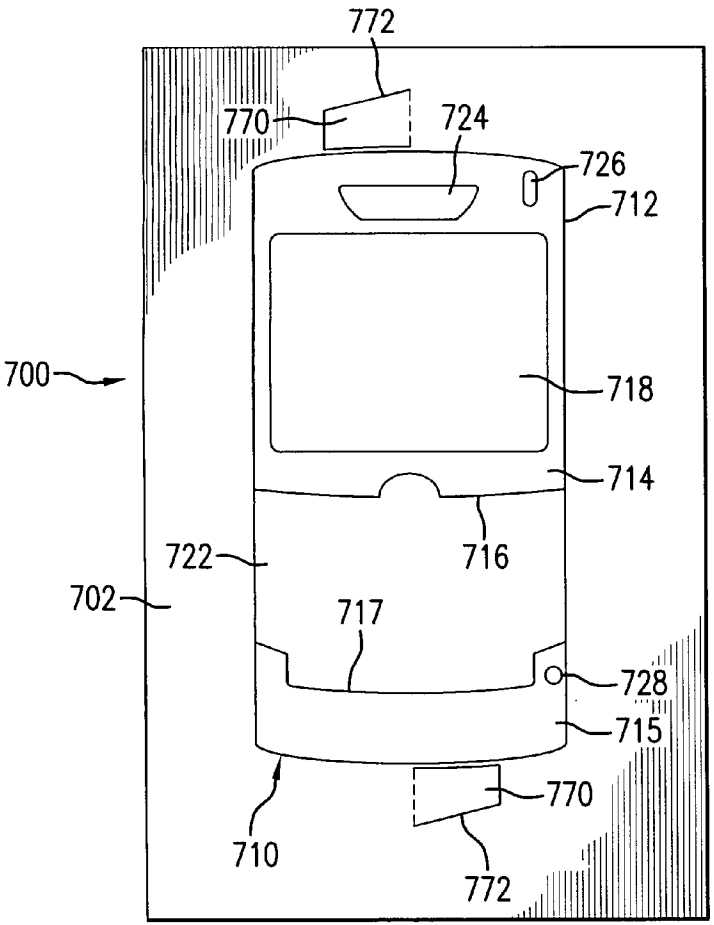

FIGS. 21 and 22 show the front and back, respectively, of a label assembly 700 according to another embodiment of this invention. Label assembly 700 includes a face sheet 702 having a printed or printable surface, shown in the view of FIG. 21, and an adjacent back sheet 704, shown in the view of FIG. 22. The surface of the face sheet 702 that is disposed toward the back sheet 704, and opposite the printed or printable surface, includes an adhesive material coating.

The label assembly 700 shown in FIGS. 21 and 22 includes a label shape 710. The label shape 710 is defined at an outer periphery by a tearable line of separation 712. In the embodiment of the invention shown in FIGS. 21 and 22, the label shape 710 is also particularly adapted to be applied to an object having a side with more than one area or surface for receiving a label. The illustrated embodiment is particularly useful in aligning label shape 710 to a cell phone or smart phone, such as a BLACKBERRY® smart phone or IPHONE™, but the application means of the embodiment of FIGS. 21 and 22 could be applied using other sizes and shapes of label shapes for other devices, such as consumer electronics or and any other object.

As shown in FIG. 21, the label shape 710 includes additional shapes defined within the periphery 712 by additional tearable lines of separation. Label shape 710 includes two shapes 714 and 715 cut within only the face sheet 702 by tearable lines of separation 716 and 717, respectively, which define the labels to be applied to surfaces of the object to be labeled. A rectangular shape 718 is also cut within the face sheet 702 by a tearable line of separation 720 and corresponds to the view screen of the smart phone. Other shapes defined by tearable lines include shape 722 which corresponds to the keyboard, shape 724 which corresponds to a decorative feature, and shapes 726 and 728 which correspond to functional features such as, for example, microphone and/or speaker openings of the smart phone. As shown in FIG. 22, the back sheet 704 can include arcuate or otherwise corresponding die cuts 727 and 729, respectively, along a portion of the shapes 726 and 728, as described above, to assist in maintaining the connection of shapes 726 and 728 to the removable panel 730.

Removable panel 730 defined in the back sheet surface 732 by at least one tearable line of separation 734 extending around the outer periphery of removable panel 730. The removable panel 730 is disposed over label shape 710. In this embodiment of the invention, the removable panel 730 is not exactly coextensive with label shape 710 and extends beyond the label shape 710 on all four sides. In this embodiment, as only one side of the object is to be labeled, the removable panel 730 comprises a single panel to be removed prior to a first adhesion of the label shape 710 to the object.

The label assembly 700 includes a registration structure, embodied in FIG. 22 as four spaced apart registration tabs 760 aligned with a portion of the label shape 710. The tabs 760 are each defined on three sides by one or more tearable lines of separation in the back sheet 704. The tabs 760 are raisable to an extended position by folding outward above the back sheet 704. In FIG. 22, fold lines 762 show where the tab 760 will desirably be folded, and can be imaginary or a perforated or otherwise scored fold line.

In the embodiment shown in FIG. 22, each of the registration tabs 760 includes a foldable portion 764 foldable about a tab fold line 766, which can be imaginary or a perforated or otherwise scored fold line. The registration tabs 760 in the embodiment of FIG. 22 are disposed external of the periphery of the label shape 710 (shown in phantom in FIG. 22) and the removable panel 730. In this embodiment of the invention, the tabs 760 are cut only in the back sheet 704, but could optionally be cut within the face sheet 702 as well.

Upon removing the removable panel 730, the object to be labeled can be aligned over the adhesive area that is under the panel 730 using the raised registration tabs 760. The label assembly 700 further includes an optional alignment structure aligned with a portion of the label shape 730 and also one of raised or raisable above the back sheet. The alignment structure includes two alignment tabs 770 defined by a tearable line of separation 772 and also positioned external of the outer periphery of the removable panel 730 and label shape 710. The tearable line of separation 772 can be cut within the back sheet 702 or both the front sheet 702 and the back sheet 704 as shown in FIGS. 21 and 22.

The label assembly is used in a manner similar to described above. If the label assembly 700 is to be printed upon, the user feeds the label assembly 700 through a suitable printer. Either the object to be labeled or the label assembly 700 is placed on a surface. The tabs 760 and 770 are raised above the back sheet 704 and the removable panel 730 is removed. In one embodiment of this invention, the object to be labeled is placed on a flat surface, such as a table. Each of the foldable portions 764 are folded about fold line 766 in a direction away from fold line 762 so that the foldable portion is at an angle to the remaining portion of the corresponding tab 760 and extending over an exposed portion of the face sheet 702.

Figure 23:
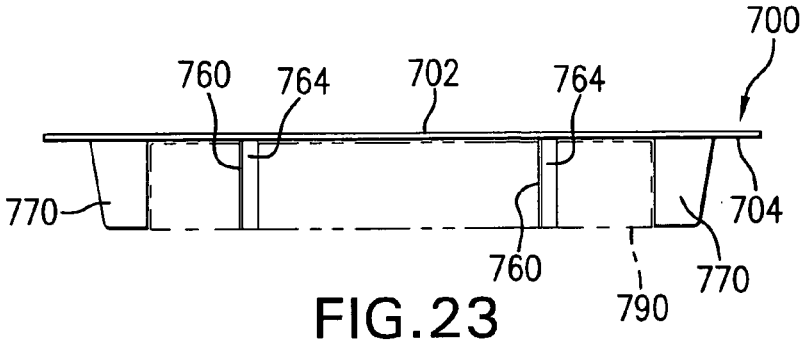
FIG. 23 illustrates the use of the label assembly of FIGS. 21 and 22.

As shown in FIG. 23, the label assembly 700 with the removed panel 730 is placed onto the object 790 (shown in phantom) from above. The tabs 760 and 770 align the label shape 710 over the object as the label assembly 700 is lowered onto the object 730. The tabs 760 and 770 can act as legs to stand the label assembly over the object until the user pats the exposed adhesive against the object to adhere the label shape 710 to the object. Desirably, the tabs are appropriately sized, e.g., slightly taller, to a thickness of the object.

Figure 24:
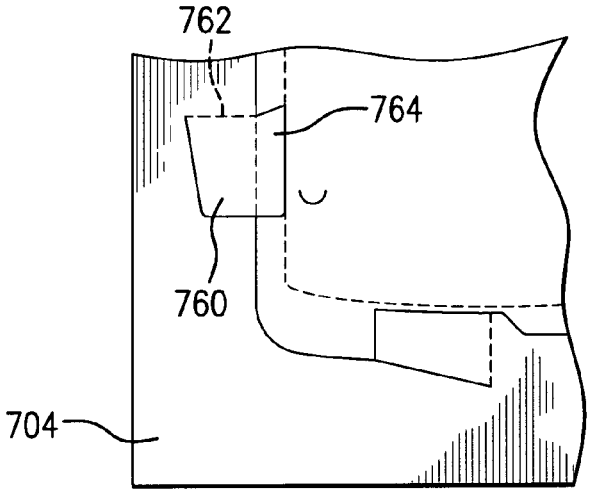
FIGS. 24 and 25 are alternative configurations of registration tabs according to one embodiment of this invention.
Figure 25:
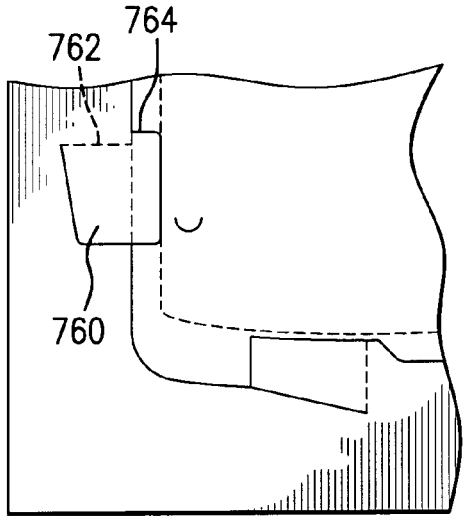
Figure 28:
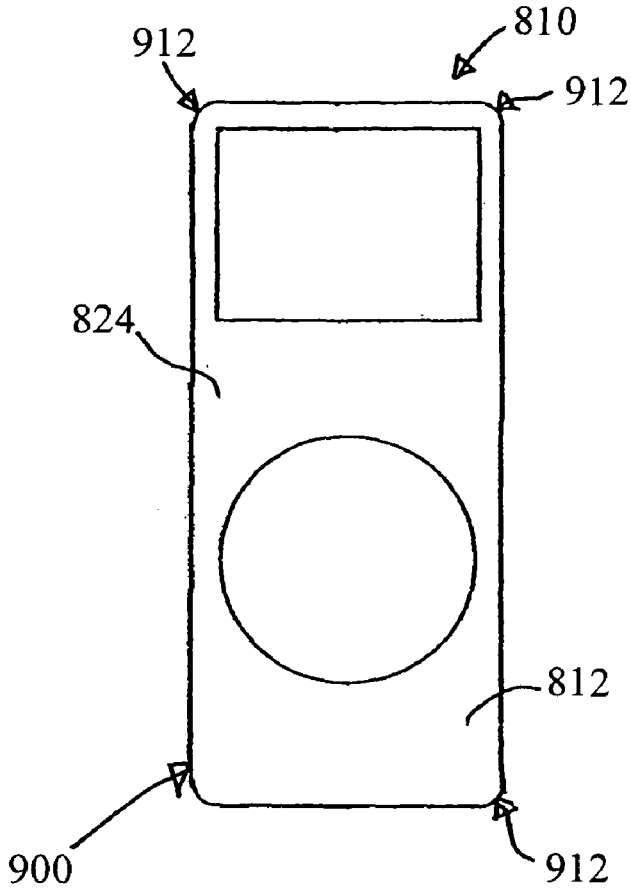
FIG. 28 is a plan view of a front panel of a label, according to one embodiment of this invention.

The foldable portions 764 provide additional strength for the tabs 760 when functioning as "legs" in use as shown in FIG. 23. The foldable portions 764 contact the underside of the remaining matrix 768 of the face sheet 702 to help keep the tabs 760 from collapsing and maintaining the label shape 710 at the desired location above the object 790 until final application. As will be appreciated various sizes, shapes and configurations are available for the registration tabs and foldable portions thereof of this invention. In one embodiment of this invention, the edge of the foldable portion 764 that contacts the bottom of the face sheet 702 is angled as shown in FIG. 24 to facilitate contact with the face sheet 702 while maintaining a desired substantially perpendicular position of tab 760 when extended. An alternative edge configuration is shown in FIG. 25, where the edge 764 is cut higher than fold line 762 by a thickness of the back sheet 704.

Once the label shape 710 is partially adhered to the object the matrix is removed from the label shape 710. The removal of the matrix is facilitated by the user separating die cut 712 and tearing the matrix from around label shape 710.

FIGS. 26-33 illustrate exemplary label materials according to additional embodiments of this invention for use in the label assemblies described above. Referring first to FIGS. 26-30, label 810 comprises first sheet 812 and second sheet 814. First sheet 812 has first outer periphery 816 and at least partially defines first shape 818. First sheet 812 includes first surface 820 and second surface 822 opposite first surface 820. First surface 820 forms front surface 824 of label 810 and second surface 822 of first sheet 812 faces second sheet 814. In one embodiment of this invention, second surface 822 of first sheet 812 faces first surface 836 of second sheet 814.

At least a portion of first surface 820 of first sheet 812 includes a printed or printable surface 825. Additionally or alternatively, at least a portion of first surface 820 of first sheet 812 includes printable coating 826. Image or information 828 can be printed on at least a portion of printable surface 825 and/or printable coating 826. As used herein, the terms "image" or "information" refer to any suitable or desirable print, photograph, electronic image, such as a digital photograph, a picture, a color, a display drawing, a letter, a text, a number, a word and/or a symbol, and/or any other desirable image or information. For example, the label of this invention adhered to an object may include one or more decorative designs selected by the user and/or selected personal information. FIG. 20 illustrates label 810 according to this invention, displaying image 828 in the form of a decorative design printed on printable surface 825 of first sheet 812.

Second sheet 814 has second outer periphery 832 and at least partially defines second shape 834. Second sheet 814 includes first surface 836 facing first sheet 812 and second surface 838 opposite first surface 836. Second surface 838 forms back surface 840 of label 810. Back surface 840 of label 810 can be an adhesive side of label 810.

Preferably, but not necessarily, first outer periphery 816 of first sheet 812 is coextensive with second outer periphery 832 of second sheet 814, as shown in FIG. 17. In at least one embodiment of this invention, as shown in FIG. 17, first shape 818 formed by first sheet 812 generally corresponds to second shape 834 formed by second sheet 814. First sheet 812 and second sheet 814 are preferably, but not necessarily, constructed of any suitable paper material, paper composite, non-metal material, metal material and/or any other suitable material that can be used as a label or as part of a label. In one embodiment of this invention, first sheet 812 and/or second sheet 814 comprise polyester. In another embodiment of this invention, first sheet 812 and/or second sheet 814 comprise vinyl.

In one embodiment of this invention, at least a portion of second sheet 814 comprises a transparent material, such as, for example, a clear vinyl and/or a clear polyester. In alternative embodiments of this invention, one or both of first sheet 812 and second sheet 814 can comprise a transparent material or a translucent material. As used herein, the term "transparent material" or the term "translucent material" relates to any material that can, at least minimally, be seen through. First sheet 812 and/or second sheet 814 of this invention made of transparent material protects a surface of an object when label 810 of this invention is in a mounted position with respect to the object, while allowing a visual access to at least a portion of the surface of the object.

Label 810 further comprises a layer of first adhesive 842 positioned between second sheet 814 and first sheet 812 such that at least a portion of first sheet 812 is adhered with respect to at least a portion of second sheet 814. One or both of second surface 822 of first sheet 812 and first surface 836 of second sheet 814 can be coated with a layer of first adhesive 842. A coating including first adhesive 842 can be applied to one or both of second surface 822 of first sheet 812 and first surface 836 of second sheet 814 in any suitable manner known to those skilled in the art. In one embodiment of this invention, first adhesive 842 comprises a dry tack adhesive. Alternatively or additionally, any other adhesive known to those skilled in the art may be used for coating second surface 822 of the first sheet 812 and/or first surface 836 of second sheet 814.

Label 810 may comprise second adhesive 844 at least partially covering second surface 838 of second sheet 814. Second adhesive 844 can be positioned between second sheet 814 and back sheet 846 so that second adhesive 844 adheres to second sheet 814 exclusively or at least adheres to second sheet 814 more than to back sheet 846 when label 810 is removed from or with respect to back sheet 846. Back sheet 846 preferably, but not necessarily, includes one side 848 having treated surface 850 to facilitate removal of label portion 810 relative to back sheet 846. Therefore, at least one side of back sheet 846, such as side 848, preferably includes a smooth and/or a release-type surface to ease separation from second surface 838 of second sheet 814 of label portion 810. Second side 852 of back sheet 846, opposite treated surface 850 of back sheet 846, may be a printable surface or any other suitable surface. One or both of second surface 838 of second sheet 814 and side 848 of back sheet 846 can be coated with second adhesive 844.

As a result of the above-described configuration, label 810 of this invention comprises first sheet 812 having first surface 820, at least a portion of which comprises printed or printable surface 825 and/or printable coating 826. Label 810 further includes second sheet 814 having first surface 836 adjacent first sheet 812 and at least partially adhered to first sheet 812 by first adhesive 842. Second sheet 814 of label 810 further comprises second surface 838, opposite first surface 836, at least partially coated with second adhesive 844 for contacting surface 856 of object 854 when label is in a mounted, connected or adhered position with respect to object 854.

Label 810 further includes at least one first void 866 formed within first shape 818, for example formed by first sheet 812. The at least one first void 866 can be formed as an opening, a cut-out, a removed section, or any other suitable space or disruption in first shape 818. In one embodiment of this invention, as shown in FIG. 26, first sheet 812 includes two voids 866 and 866' formed as first first sheet opening 868 and second first sheet opening 870. First first sheet opening 868 and second first sheet opening 870 can be formed or cut within first shape 818 formed by first sheet 812 of label 810.

Figure 31:
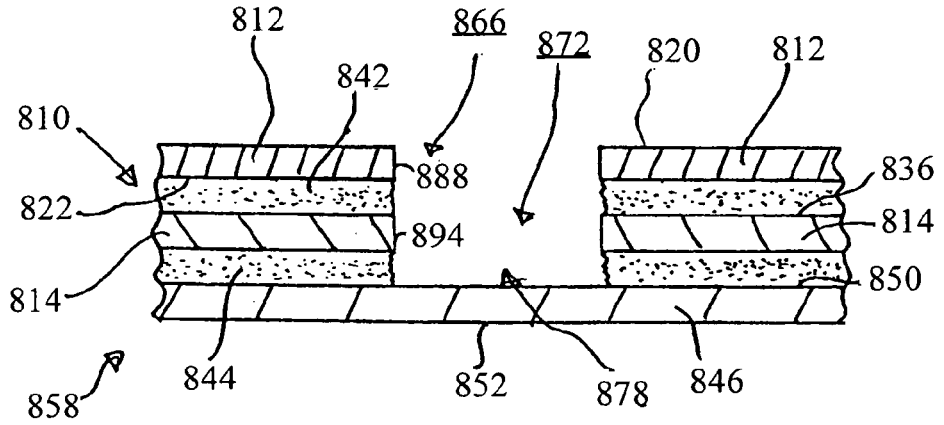
FIG. 31 is a partial and sectional view of a label assembly, according to one embodiment of this invention.
Figure 33:
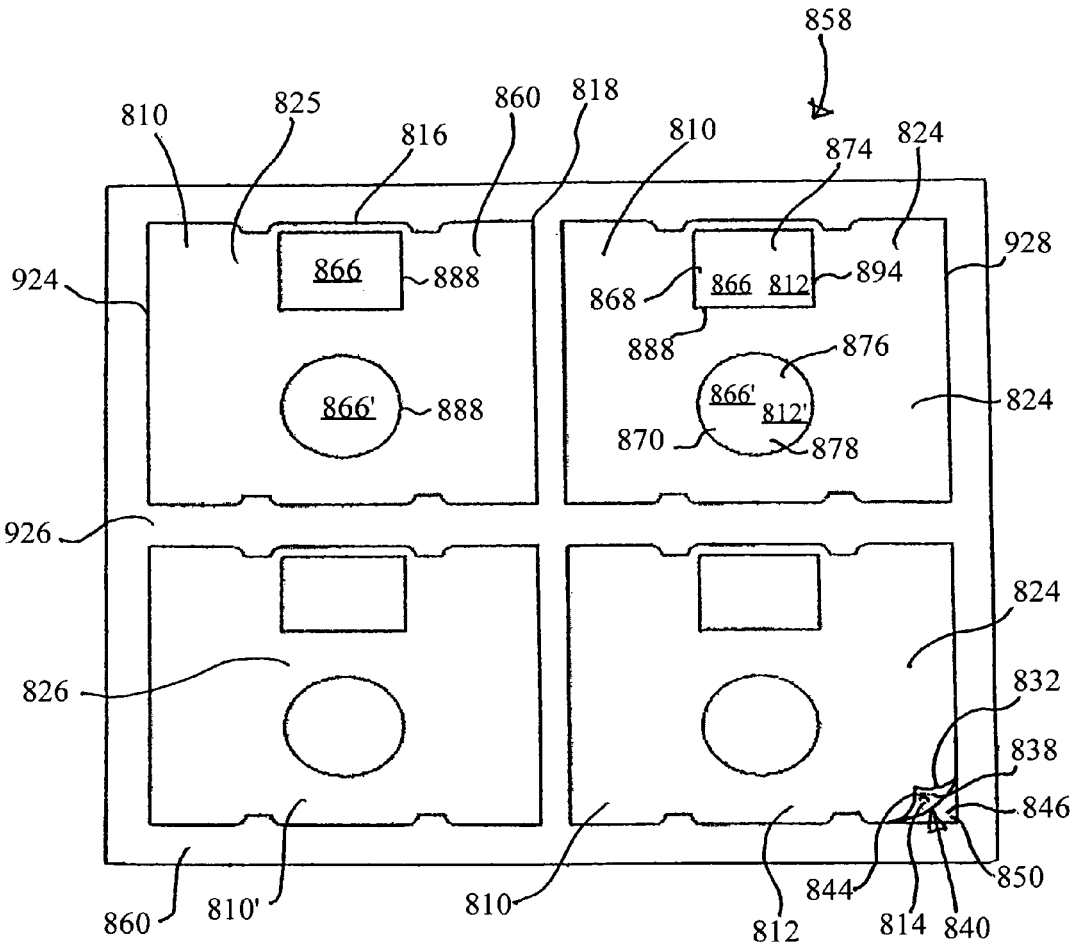
FIG. 33 is a plan view of a label assembly, according to one embodiment of this invention.

In one embodiment of this invention, such as shown in FIG. 31, at least one second void 872 is formed within second shape 834 formed by second sheet 814. The at least one second void 872 can be formed as an opening, a cut-out, a removed section, or any other suitable space or disruption in second shape 834. In one embodiment of this invention, as shown in FIG. 33, second sheet 814 includes two second voids 872 and 872' formed as first second sheet opening 874 and second second sheet opening 876. First second sheet opening 874 and second second sheet opening 876 are formed or cut within second shape 834 formed by second sheet 814 of label 810. At least one of first second sheet opening 874 and second second sheet opening 876 preferably is positioned to correspond to one of first first sheet opening 868 and second first sheet opening 870 formed within first shape 818 formed by first sheet 812.

Figure 32:
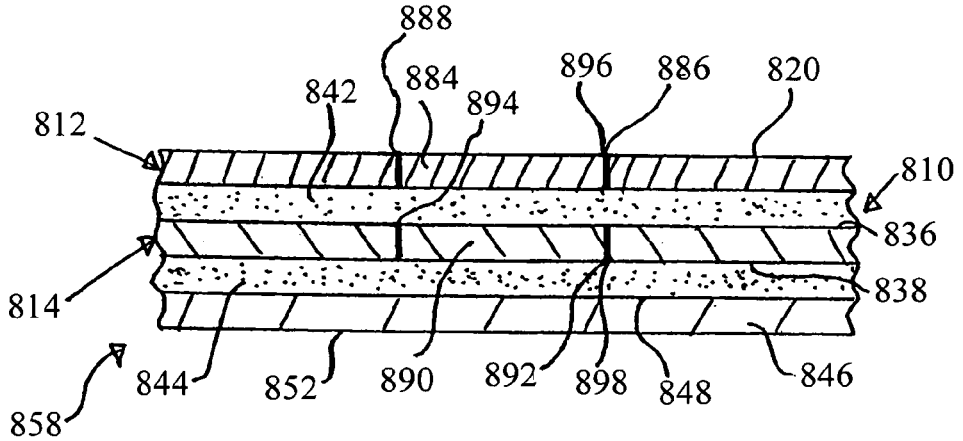
FIG. 32 is a partial and sectional view of a label assembly, according to another embodiment of this invention.

Referring generally to FIGS. 31-33, the at least one first void 866 formed within first shape 818 may generally correspond to and/or be generally aligned with the at least one second void 872 formed within second shape 834 such that at least one label void or opening 878 is formed within label 810. Label 810 having at least one first void 866 aligned with at least one second void 872 is positionable around object 854. The at least one label void or opening 878 formed within label portion 810 can be aligned with or over area 880 of object 854. When label 810 of this invention is in a mounted position with respect to surface 856 of object 854, at least one label void or opening 878 formed by corresponding first and second voids 866 and 872, respectively, can be used to access area 880 on surface 856 of object 854. For example, in one embodiment of this invention, as shown in FIG. 20, label void or opening 878 allows access to control panel 882 positioned on surface 856 of object 854. Additionally or alternatively, label void or opening 878 can help slidably position label 810 about a projection (not shown) extending from surface 856 of object 854.

In one embodiment of this invention, as shown in FIG. 27, label 810 includes at least one first void 866 in first shape 818 of first sheet 812, but label 810 has no second void in second sheet 814. In such embodiment of this invention, at least a portion of second sheet 814 corresponding to the at least one void 866 in first sheet 812 may comprise a translucent or transparent material. In another embodiment of this invention, as shown in FIG. 31, label 810 comprises first void 866 within first shape 818 formed by first sheet 812 and a corresponding second void 872 within second shape 834 formed by second sheet 814. Alternative embodiments of this invention may include labels having any number of corresponding or not corresponding first voids and/or second voids.

In one embodiment of this invention, the at least one first void 866 in first sheet 812 can be formed by removing at least one first removable portion 884 formed or cut within first sheet 812. The at least one first removable portion 884 is removable with respect to first sheet 812 to form the at least one first void 866 within first outer periphery 816 of first sheet 812. An outer periphery or shape 886 of first removable portion 884 can be positioned generally coextensive with or to correspond to a perimeter or shape 888 of first void 866.

In one embodiment of this invention, the at least one second void 872 in second sheet 814 can be formed by removing at least one second removable portion 890 formed or cut within second sheet 814. The at least one second removable portion 890 is removable with respect to second sheet 814 to form the at least one second void 872 within second outer periphery 832 of second sheet 814. As shown in FIG. 32, an outer periphery or shape 892 of second removable portion 890 can be positioned generally coextensive with or to correspond to a perimeter or shape 894 of second void 872. Second removable portion 890, as shown in FIG. 32, can be removed by adhering to the removable panel (not shown) while the removable panel is removed from back sheet 846 as discussed above.

In one embodiment of this invention, first removable portion 884 has one of a circular shape, an elliptical shape, a polygonal shape and/or any other suitable non-circular shape, and second removable portion 890 preferably, but not necessarily, has a shape generally corresponding to the shape of first removable portion 884 such that outer periphery 886 of first removable portion 884 is positioned generally coextensive with or to correspond to outer periphery 892 of second removable portion 890. It is apparent to those skilled in the art that each removable portion can have any suitable shape, size and/or dimensions.

First removable portion 884 is preferably defined or formed by first line of separation 896, and second removable portion 890 is preferably defined or formed by second line of separation 898, as shown respectively in FIG. 32. First line of separation 896 preferably extends at least partially along perimeter 888 of first void 866 to define first removable portion 884. Second line of separation 898 preferably extends at least partially along perimeter 894 of second void 872 to define second removable portion 890.

Referring generally to FIGS. 23 and 25-27, label 810 according to one embodiment of this invention defines front panel 900, two side panels 902 and 902' and two flaps 904 and 904'. Side panel 902 is adjacent first side 906 of front panel 900. Side panel 902' is adjacent second side 906' of front panel 900, positioned opposite of first side 906. Flap 904 is adjacent side 908 of side panel 902, positioned opposite of front panel 900. Flap 904' is adjacent side 908' of side panel 902', positioned opposite of front panel 900. Front panel 900, side panels 902 and 902' and flaps 904 and 904' are preferably sized and shaped to fit the dimensions of at least one surface of an object and/or to create a desirable label configuration on the object. Any void and/or opening and/or removable portion within label 810 is similarly sized and shaped to fit around or correspond to at least one characteristic of an object, such as, for example, a control, a control panel, an LCD screen or other monitor, a button, a surface projection and/or other characteristics of an object.

Figure 29:
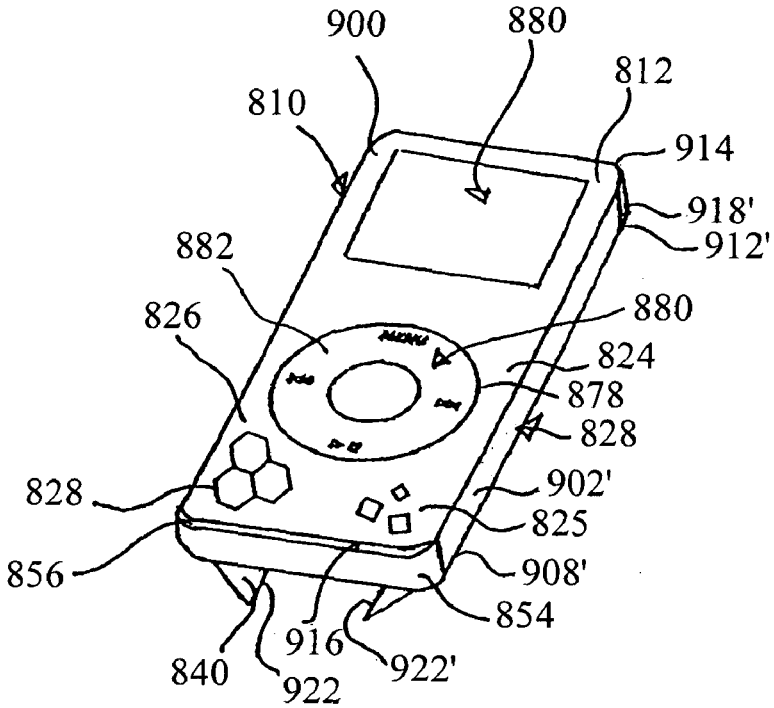
FIG. 29 is a perspective view of a label partially mounted to a player device, according to one embodiment of this invention.
Figure 30:
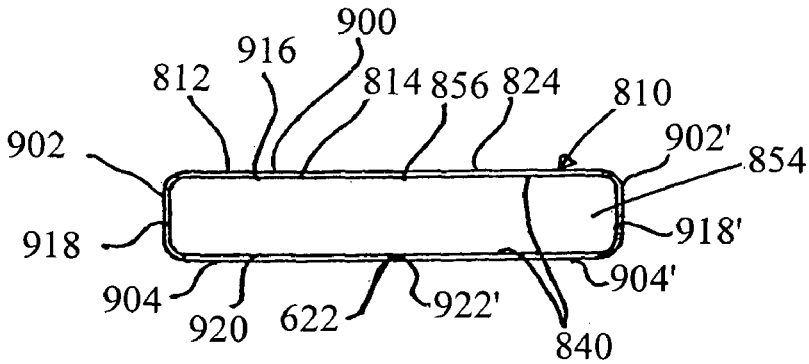
FIG. 30 is a side view of a label mounted to a player device, according to another embodiment of this invention.

In one embodiment of this invention, as shown in FIGS. 29 and 30, label portion 810 is sized and shaped to fit around and at least partially adhere to object 854, which, for example, can be any suitable digital media player, digital music player, MP3 player, and/or any other personal device. In one embodiment of this invention, each of front panel 900, side panels 902 and 902' and flaps 904 and 904' comprises a generally rectangular shape. One or more corners 912, 912' and/or 912" of the generally rectangular front panel 900, side panels 902 and 902' and flaps 904 and 904' can be rounded or otherwise shaped to better fit one or more surfaces of object 854. Preferably, but not necessarily, at least a portion of first outer periphery 816 of first sheet 812 and at least a portion of second outer periphery 832 of second sheet 814 are flush with at least a portion of edge 914 of surface 856 of object 854.

In one embodiment of this invention, the front panel has a generally rectangular shape with dimensions of about 40 millimeters by about 90 millimeters. The first void within the first sheet of the label has a generally rectangular shape with dimensions of about 22 millimeters by about 30 millimeters. Another first void within the first sheet of the label has a generally circular shape having a diameter of about 30 millimeters. The second sheet may include one or more corresponding second voids within the second sheet. Each of the two side panels has a generally rectangular shape having a width of about 7 millimeters and a length shorter than about 90 millimeters. Each of the two flaps has a length of about 90 millimeters.

Label 810 according to this invention, as shown in FIGS. 29 and 30, is at least partially wrappable or positionable around object 854 such as by the method described above, and at least a portion of label 810 is adherable to at least one surface of object 854. FIG. 29 shows label 810 according to this invention partially wrapped around and adhered to object 854. In a mounted position, at least a portion of front panel 900 is adhered to front surface 916 of object 854. At least a portion of side panel 902 and 902' is adhered to side surface 918 and 918', respectively, of object 854. At least a portion of flap 904 and 904' is adhered to back surface 920 of object 854. In one embodiment of this invention, as shown in FIG. 30, label 810 is sized to fit snugly about or around object 854, when label 810 is in a mounted position, so that outside edge 922 of flap 904 is flush with outside edge 922' of flap 904'. In such configuration, no substantial gap is formed between outside edge 922 of flap 904 and outside edge 922' of flap 904'. In other and alternative embodiments of this invention, flaps 904 and 904' can overlap or a gap can be formed between outside edge 922 of flap 904 and outside edge 922' of flap 904' when label 810 is in amounted position on object 854.

It is apparent to those skilled in the art that the label and/or portions of the label, according to this invention, can have any suitable shape and/or size that results in a desired placement of the label on an object. FIG. 33 illustrates label assembly 858, according to one embodiment of this invention that includes a plurality of label portions 810.

Thus the invention provides a label assembly with a registration structure that promotes the desired straightened and/or central alignment of a label to an object. The label assembly of this invention allows for application of a label to an object without the need for a separate label application apparatus, while still providing the desired placement on the object, such as centered placement of a label on an MP3 player or cell phone.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A label assembly including a face sheet with at least one label shape defined by at least one tearable line of separation, a back sheet adjacent to the face sheet, and an adhesive material disposed between the face sheet and the back sheet, the label assembly comprising:

the back sheet including a removable panel disposed over the label shape; and a registration tab defined by at least one tearable line of separation and aligned with a portion of the label shape, the registration tab raisable above the back sheet and including a tab fold line defining a foldable portion.

2. The label assembly according to claim 1, further comprising a plurality of registration tabs each defined by at least one tearable line of separation and aligned with a portion of the label shape, each of the registration tabs raisable above the back sheet and including a tab fold line defining a foldable portion.

3. The label assembly according to claim 1, wherein the tab fold line is substantially perpendicular to a fold line connecting the registration tab to the back sheet.

4. The label assembly according to claim 1, wherein the tab fold line of the registration tab comprises a perforated fold line.

5. The label assembly according to claim 1, wherein an edge of the foldable portion is aligned with a portion of the label shape.

6. The label assembly according to claim 5, wherein a portion of an outer periphery of the removable panel is offset from an outer periphery of the label shape.

7. The label assembly according to claim 1, wherein the registration tab is positioned external of an outer periphery of the removable panel.

8. The label assembly according to claim 1, wherein the registration tab is cut into the back sheet and is not cut into the face sheet, wherein the registration tab is raisable by folding outward above the back sheet.

9. The label assembly according to claim 1, further comprising an alignment structure aligned with a portion of the label shape and one of raised or raisable above the back sheet.

10. The label assembly according to claim 9, wherein the alignment structure is positioned along a different side of the removable panel from the registration tab and external of an outer periphery of the removable panel.

11. The label assembly according to claim 9, wherein the alignment structure comprises a tab defined by a tearable line of separation in both the back sheet and the face sheet, wherein the tab is raisable by folding outward above the back sheet.

12. The label assembly according to claim 1, wherein the removable panel comprises two panel portions and one of the two panel portions comprises the registration tab.

13. The label assembly according to claim 12, wherein the registration tab is disposed within a periphery of one of the two panel portions and adjacent an other of the two panel portions.

14. A label assembly, comprising:

a face sheet having a printed or printable surface;

a label shape defined in the face sheet by at least one first tearable line of separation;

an adhesive material coating a surface of the face sheet opposite the printed or printable surface;

a back sheet disposed over the adhesive material, the back sheet including a back sheet surface opposite the adhesive material;

a removable panel defined in the back sheet by at least one second tearable line of separation and disposed over the label shape; and a registration tab cut in the back sheet and raisable above the back sheet surface, the registration tab including a tab fold line defining a foldable portion aligned with the first label shape.

15. The label assembly according to claim 14, wherein the foldable portion is disposed along an edge of the label shape.

16. The label assembly according to claim 14, wherein the back sheet comprises a remaining portion disposed around the removable panel and an alignment structure aligned with a portion of the label shape and raisable above the back sheet, the alignment structure positioned external of an outer periphery of the removable panel.

17. The label assembly according to claim 14, further comprising at least one further shape defined within the label shape of the face sheet by at least one first tearable line of separation.

18. A method for labeling an object with a label from a label assembly, the method comprising:

providing a label assembly including a face sheet with a label shape defined by at least one tearable line of separation, a back sheet adjacent to the face sheet, a removable panel disposed over the label shape, a registration tab defined by at least one tearable line of separation in the back sheet and raisable above the back sheet, and an adhesive material disposed between the face sheet and the back sheet;

placing the object on a surface;

removing the removable panel to expose the adhesive material on a first portion of the label shape;

aligning the registration tab with the object;

placing the label assembly over the object with the registration tab against the object;

adhering the label shape to the first portion of the label shape; and removing the object with the adhered label shape from the label assembly.

19. The method of claim 18, wherein the registration tab is defined by a tearable line of separation in the back sheet and further comprising raising the registration structure above the back sheet before placing the object against the registration structure.

20. The method of claim 19, wherein the registration tab includes a foldable portion and further comprising folding the foldable portion.

21. The method of claim 18, further comprising routing the label assembly through a printer and printing on the label shape before placing the label assembly on a surface with the face sheet downward on a surface.

* * * * *